US007428976B2

(12) United States Patent
Cheng et al.

(10) Patent No.: US 7,428,976 B2
(45) Date of Patent: Sep. 30, 2008

(54) METHOD FOR MAKING MESH CONTAINERS WITH A RAIL AND MESH CONTAINER FORMED THEREFROM

(75) Inventors: Hsi-Ming Cheng, Chung-Hua Hsien (TW); R. Neal Post, Springfield, IL (US); Christopher Hardy, Springfield, IL (US)

(73) Assignee: Design Ideas, Ltd., Springfield, IL (US)

( * ) Notice: Subject to any disclaimer, the term of this patent is extended or adjusted under 35 U.S.C. 154(b) by 152 days.

(21) Appl. No.: 11/000,295

(22) Filed: Nov. 30, 2004

(65) Prior Publication Data

US 2005/0077299 A1 Apr. 14, 2005

Related U.S. Application Data

(63) Continuation-in-part of application No. 10/972,308, filed on Oct. 22, 2004, now Pat. No. 7,270,245, which is a continuation of application No. 10/308,699, filed on Dec. 3, 2002, now abandoned.

(51) Int. Cl.

| | |
|---|---|
| ***B65D 6/08*** | (2006.01) |
| ***B65D 6/32*** | (2006.01) |
| ***B65D 6/36*** | (2006.01) |
| *B65D 25/00* | (2006.01) |

(52) U.S. Cl. ..... 220/642; 220/62; 220/485; 220/607; 220/676; 29/509

(58) Field of Classification Search ..... 220/491, 220/492, 494, 485, 640–642, 646, 648, 62, 220/607, 676; 29/509, 512

See application file for complete search history.

(56) References Cited

U.S. PATENT DOCUMENTS 171,032 A 12/1875 Meyers (Continued)

FOREIGN PATENT DOCUMENTS

DE 1083999 6/1960

(Continued)

OTHER PUBLICATIONS

Millers Office Products, p. 442, 1995.

(Continued)

*Primary Examiner*—Anthony D Stashick
*Assistant Examiner*—NIki M. Eloshway
(74) *Attorney, Agent, or Firm*—Saidman DesignLaw Group

(57) ABSTRACT

The present invention is directed to a method of forming a container comprising forming a basket portion of metal mesh material and a rail connected to the basket portion. The rail extends substantially outwardly from the outer surface of the basket portion and the rail extends continuously around the outer surface of the basket portion. In one example, the method includes forming the rail so that it does not contain or surround a free edge of the basket portion. In another example, the method includes forming the rail so that it includes an opening for containing or surrounding a free edge of the basket portion. The method may also include forming a lower rail. The present invention is also directed to a container formed by such method.

3 Claims, 27 Drawing Sheets

U.S. PATENT DOCUMENTS

| | | | | | |
|---|---|---|---|---|---|
| 201,959 | A | | 4/1878 | Stockwell et al. | |
| 463,964 | A | | 11/1891 | Gates | |
| 900,162 | A | | 10/1908 | Goodwin | |
| 920,313 | A | | 5/1909 | Franklin | |
| 933,517 | A | | 9/1909 | Worcester | |
| 981,205 | A | | 1/1911 | Loetzer | |
| 994,984 | A | | 6/1911 | Dennis | |
| 1,098,053 | A | | 5/1914 | Porter | |
| 1,138,496 | A | | 5/1915 | Martin | |
| 1,224,234 | A | | 5/1917 | Taber | |
| 1,305,148 | A | | 5/1919 | Montan | |
| 1,382,592 | A | | 6/1921 | Ames | |
| 1,384,755 | A | | 7/1921 | Hall | |
| 1,389,908 | A | | 9/1921 | Shults et al. | |
| 1,445,259 | A | | 2/1923 | Wiselogel | |
| 1,463,098 | A | | 7/1923 | Snyder | |
| 1,484,696 | A | | 2/1924 | Wulftange | |
| 1,660,410 | A | | 2/1928 | Beckman | |
| 1,688,846 | A | | 10/1928 | Andrews | |
| 1,840,561 | A | | 1/1932 | Miller | |
| 1,890,983 | A | | 12/1932 | Griffith | |
| 1,950,921 | A | | 3/1934 | Gray et al. | |
| 2,009,527 | A | | 7/1935 | Shelton | |
| 2,050,980 | A | * | 8/1936 | Buhl | 220/640 |
| 2,502,781 | A | | 4/1950 | Erickson | |
| 2,507,152 | A | | 5/1950 | Garofalo | |
| 2,574,998 | A | * | 11/1951 | Bangert, Jr. | 220/62 |
| 2,658,444 | A | | 11/1953 | Wheeler | |
| 2,706,064 | A | | 4/1955 | Vitols | |
| 2,721,671 | A | | 10/1955 | Averill | |
| 2,768,022 | A | | 10/1956 | Pope | |
| 2,826,329 | A | | 3/1958 | Beckner | |
| 2,898,122 | A | | 8/1959 | Beckner | |
| D194,513 | S | | 2/1963 | Sparling | |
| 3,120,323 | A | | 2/1964 | Sparling | |
| 3,138,281 | A | | 6/1964 | Schray | |
| 3,250,430 | A | | 5/1966 | Cella | |
| 3,272,377 | A | | 9/1966 | Schray | |
| 3,436,044 | A | | 4/1969 | Martinson | |
| 3,563,292 | A | | 2/1971 | Gordon | |
| 3,923,187 | A | | 12/1975 | Johansson et al. | |
| 4,173,289 | A | | 11/1979 | Nesti | |
| 4,205,406 | A | | 6/1980 | Wangkeo et al. | |
| D298,403 | S | | 11/1988 | Magberg et al. | |
| 4,903,853 | A | * | 2/1990 | Lin | 220/6 |
| D328,993 | S | | 9/1992 | Rosenthal | |
| D341,459 | S | | 11/1993 | Yang | |
| D373,039 | S | | 8/1996 | Cohen et al. | |
| D383,283 | S | | 9/1997 | Hankins, III | |
| D393,766 | S | | 4/1998 | Mazzola et al. | |
| 5,810,179 | A | | 9/1998 | Kleiman | |
| 5,851,393 | A | * | 12/1998 | Carr et al. | 210/489 |
| D416,165 | S | | 11/1999 | Zemel | |
| D419,302 | S | | 1/2000 | Hardy et al. | |
| D433,709 | S | | 11/2000 | Hardy | |
| D437,984 | S | | 2/2001 | Weiss et al. | |
| D444,039 | S | | 6/2001 | Tong | |
| D444,927 | S | | 7/2001 | Lin | |
| D451,675 | S | | 12/2001 | Hardy et al. | |
| D453,027 | S | | 1/2002 | Andujar | |
| D455,029 | S | | 4/2002 | Gusdorf | |
| 6,461,501 | B1 | | 10/2002 | Porter | |
| 6,718,635 | B2 | * | 4/2004 | Cheng et al. | 29/896.6 |
| 7,228,985 | B2 | | 6/2007 | Yeh | |

FOREIGN PATENT DOCUMENTS

| | | |
|---|---|---|
| FR | 826876 | 4/1938 |
| GB | 228338 | 2/1925 |
| GB | 730785 | 6/1955 |
| JP | 2001-270515 | 2/2001 |
| TW | 086202707 | 2/1998 |

OTHER PUBLICATIONS

Hong Kong Enterprise, Oct. 1999, p. 98.
Hong Kong Enterprise, Oct. 1999, p. 1126.
Baigelman & Co., Office Products Catalog, 2000, item A, p. 492.
The Container Store, The Ultimate Planning Guide, revised Nov. 2001.

* cited by examiner (A)

(B)

(C)

(D)

[図7]

METHOD FOR MAKING MESH CONTAINERS WITH A RAIL AND MESH CONTAINER FORMED THEREFROM

CROSS-REFERENCE TO RELATED APPLICATIONS

This application is a continuation-in-part of our prior pending application Ser. No. 10/972,308, filed Oct. 22, 2004 now U.S. Pat. No. 7,270,245, which is a continuation of Ser. No. 10/308,699, filed Dec. 3, 2002 now abandoned, which claims priority to the prior ROC (Taiwan) Patent Application No. 090220946, filed Dec. 3, 2001; ROC (Taiwan) Patent Application No. 091202306, filed Apr. 16, 2002; and ROC (Taiwan) Patent Application No. 091214244, filed Sep. 11, 2002. This application also claims priority to the prior ROC (Taiwan) Patent Application No. 093211506, filed Jul. 21, 2004; China Patent Application No. 200420084938.8, filed Jul. 28, 2004; ROC (Taiwan) Patent Application No. 093211507, filed Jul. 21, 2004; and China Patent Application No. 200420084546.1, filed Jul. 29, 2004. These applications are incorporated by reference herein in their entirety.

BACKGROUND OF THE INVENTION

1. Field of the Invention

The present invention relates to containers, a system using such containers, and a method of making such containers. More particularly, the present invention relates to rails for use with drawers made of mesh material.

2. Description of Related Art

Forming containers out of sheet metal is well known. U.S. Pat. No. 903,848 to Donnelly and 1,107,014 to Avery disclose such containers. In order to make these containers, a single blank of flat material is cut out and folded with overlapping sections. Sheet metal does not provide desirable characteristics such as drainage and ventilation.

In an effort to make a well-ventilated container, U.S. Pat. No. 645,344 to White discloses a container formed of perforated sheet metal, wire-netting or another open-work material. The White container is intended to have a folded state and a flat state. This container is designed to be readily knocked down from its folded state to its flat state and to be easily constructed without tools.

Other patents attempt to make lightweight, drainable and/or ventilated containers. U.S. Pat. No. 1,994,553 to Wolcott discloses one such container of finely woven wire screening. U.S. Pat. No. 2,825,481 to Glenny discloses another such container of finely woven wire screening. In order to make the White, Wolcott and Glenny containers, a single blank of flat woven wire is cut out and folded with overlapping sections.

Another wire container that is commercially available under the brand name Elfa® is formed of a wire grid with a plurality of separately formed wires welded together. The Elfa® container includes a basket portion and a flat rail around the top edge of the basket portion. The Elfa® baskets are designed for use in a frame having a plurality of pairs of runners. When the baskets are inserted in the frame, the flat rail is supported by a pair of runners and is movable between retracted and extended positions. The wire grid used for the Elfa® basket has large holes measuring about 1 inch by 1 inch. The Elfa® basket also has openings at its corners. If a user desires to store small objects in these baskets, a plastic liner can be used. The liner has a bottom wall and upwardly bendable sidewalls, with slits between the sidewalls to allow for such bending. The open corners of the basket and the slits between the sidewalls of the liner may allow small objects to fall out of the basket, which is undesirable.

Mesh material is typically formed by perforating or slitting a piece of sheet metal and stretching it. A sheet of mesh material requires less raw sheet metal than a non-mesh piece of sheet metal and a perforated piece of sheet metal. U.S. Pat. No. 1,408,026 to Ochiltree discloses a desk tray or basket formed of "expanded metal" or mesh material. Similar to the previous containers, the Ochiltree container is formed by a single blank of flat material that is cut out and folded.

ROC (Taiwan) Patent Application No. 086202709 to Chih-Ming, Ko (in transliteration), filed Feb. 21, 1997, discloses a system of containers supported by a frame. The containers are formed of a single piece of mesh with a rim connected thereto. Additionally, the containers do not move with respect to the frame so that the contents of the lower container are not easily accessible.

A number of mesh containers are made by Design Ideas, Ltd. One of these containers is the "Mesh Storage Nest." This container is formed using a first piece of mesh that has the ends welded together to form a loop. A second piece of mesh is welded to the lower edge of the loop so that the first piece of mesh forms sidewalls and the second piece of mesh forms a bottom wall. The seam at the bottom of the container is covered by a bottom rail. A top rail is connected to the upper edge of the container. The sidewalls can be shaped to include a plurality of corners.

A need exists for a lightweight container that can be incorporated into a system for storing objects. It is also desirable that the contents of such a container be made easily accessible and be prevented from accidentally falling through holes in the container. Furthermore, it is desirable that the container be formed by an economical method in unlimited sizes.

SUMMARY OF THE INVENTION

The present invention is directed to a method of forming a container comprising the following step: forming a basket portion of metal mesh material into a bottom wall and upwardly extending first and second spaced apart sidewalls and upwardly extending third and fourth spaced apart sidewalls, the first, second, third and fourth sidewalls including an outer surface. The method further includes the following steps: forming a rail; and joining the rail to the outer surface such that a substantial portion of the rail extends substantially outwardly from the outer surface of the first, second, third and fourth sidewalls, and the rail extending substantially continuously around the outer surface of the basket portion.

In one example, the step of joining further includes spacing the rail from a free edge of the basket portion so that an upper section of the basket portion extends above the rail. In such a method, the method further includes the step of cutting the upper section of the basket portion from the remaining portion of the basket portion.

In another example of the method, the rail is generally L-shaped and has a first portion joined to the basket portion and a second outwardly-extending portion. In such a method, the rail further includes a projecting connection portion that becomes integral with the sidewalls after joining the rail to the basket portion. Such method may further include forming a second rail having a L-shape and two connection portions. The second rail being joined to the sidewalls and the bottom wall such that the connection portions become integral therewith.

In yet another example, the step of joining further includes containing a free edge of the basket portion with the rail. In such an example, the step of forming the rail further includes forming the rail with a curved portion having an opening and a curved section joining first and second sections of the rail. The method further including the step of inserting the free edge of said basket portion within the opening.

According to one aspect of the present invention, the step of forming said rail further includes forming said rail with a first extension coupled to and angularly offset from the first section.

According to another aspect of the present invention, the step of forming said rail further includes forming said rail with a second extension coupled to and angularly offset from the second section.

The present invention is directed to a method of forming a container comprising the following step: forming a basket portion of metal mesh material into a bottom wall and upwardly extending first and second spaced apart sidewalls and upwardly extending third and fourth spaced apart sidewalls. The method further includes the following steps: bending an upper section of the first, second, third and fourth sidewalls outwardly; forming a rail including an opening; inserting the upper section of the first, second, third and fourth sidewalls into the opening; and compressing the rail to engage the upper section of the first, second, third and fourth sidewalls.

According to one example of the inventive method, the rail forming step further includes forming a curved portion having the opening and the rail forming step further includes an extension angularly offset from the curved portion. In addition, the inserting step further includes locating the extension adjacent the basket portion; and the method further includes welding the extension to the first, second, third and fourth sidewalls.

According to another aspect of the present invention, the rail forming step further includes forming the rail with a curved portion and a curved section joining first and second sections of the rail and the curved portion forms the opening, and the method further includes forming the rail with first and second extensions angularly offset from the curved portion. Additionally, the compression step further includes locating the first extension adjacent an outer surface of the first, second, third and fourth sidewalls and locating the second extension adjacent an inner surface of the first, second, third and fourth sidewalls. The method further includes welding the first extension to the outer surface of the first, second, third and fourth sidewalls and welding the second extension to the inner surface of the first, second, third and fourth sidewalls.

The present invention is also directed to a container comprising a basket portion and a rail. The basket portion is formed of metal mesh material that includes a bottom wall and upwardly extending first and second spaced apart sidewalls and upwardly extending third and fourth spaced apart sidewalls. The basket portion further includes an outwardly extending upper section of the first, second, third and fourth sidewalls. The rail includes an opening for receiving the upper section of the first, second, third and fourth sidewalls. The opening is sized so that the rail contacts opposing surfaces of said upper section.

According to one aspect of the present invention, the rail further includes a curved portion and an extension angularly offset from the curved portion. The curved portion defines the opening and the extension is joined to the first, second, third and fourth sidewalls.

According to another aspect of the present invention, the rail further includes first and second extensions angularly offset from a curved portion. The first extension is joined to an outer surface of the first, second, third and fourth sidewalls and the second extension is joined to an inner surface of the first, second, third and fourth sidewalls.

According to one feature of the present invention, the rail is a substantially continuous piece of material.

According to one feature of the present invention, the basket portion includes open corners between the first and second sidewalls and the third and fourth sidewalls. According to another feature of the present invention, the basket portion includes closed corners between the first and second sidewalls and the third and fourth sidewalls.

The present invention is also directed to a container comprising a basket portion and first and second rails. The basket portion is formed of metal mesh material and includes a bottom wall and upwardly extending first and second spaced apart sidewalls and upwardly extending third and fourth spaced apart sidewalls. The first rail has a L-shape and is joined to the first, second, third and fourth sidewalls. The second rail has a L-shape and is joined to the sidewalls and the bottom wall.

In an alternative example, the first rail further includes a first projecting connection portion that contacts the sidewalls and becomes integral therewith, when the first rail is joined to the basket portion. In yet another alternative example, the second rail further includes at least one second projecting connection portion. The second projecting connection portion contacts the sidewalls or bottom wall and becomes integral therewith, when the second rail is joined to the basket portion.

Alternatively, the present invention is directed to a container with a first rail or a second rail.

BRIEF DESCRIPTION OF THE DRAWINGS

The present invention will be more fully appreciated as the same becomes understood from the following detailed description of the best mode presently contemplated for carrying out the present invention when viewed in conjunction with the accompanying drawings, in which.

DETAILED DESCRIPTION OF EXAMPLES OF THE PRESENT INVENTION

Figure 1:
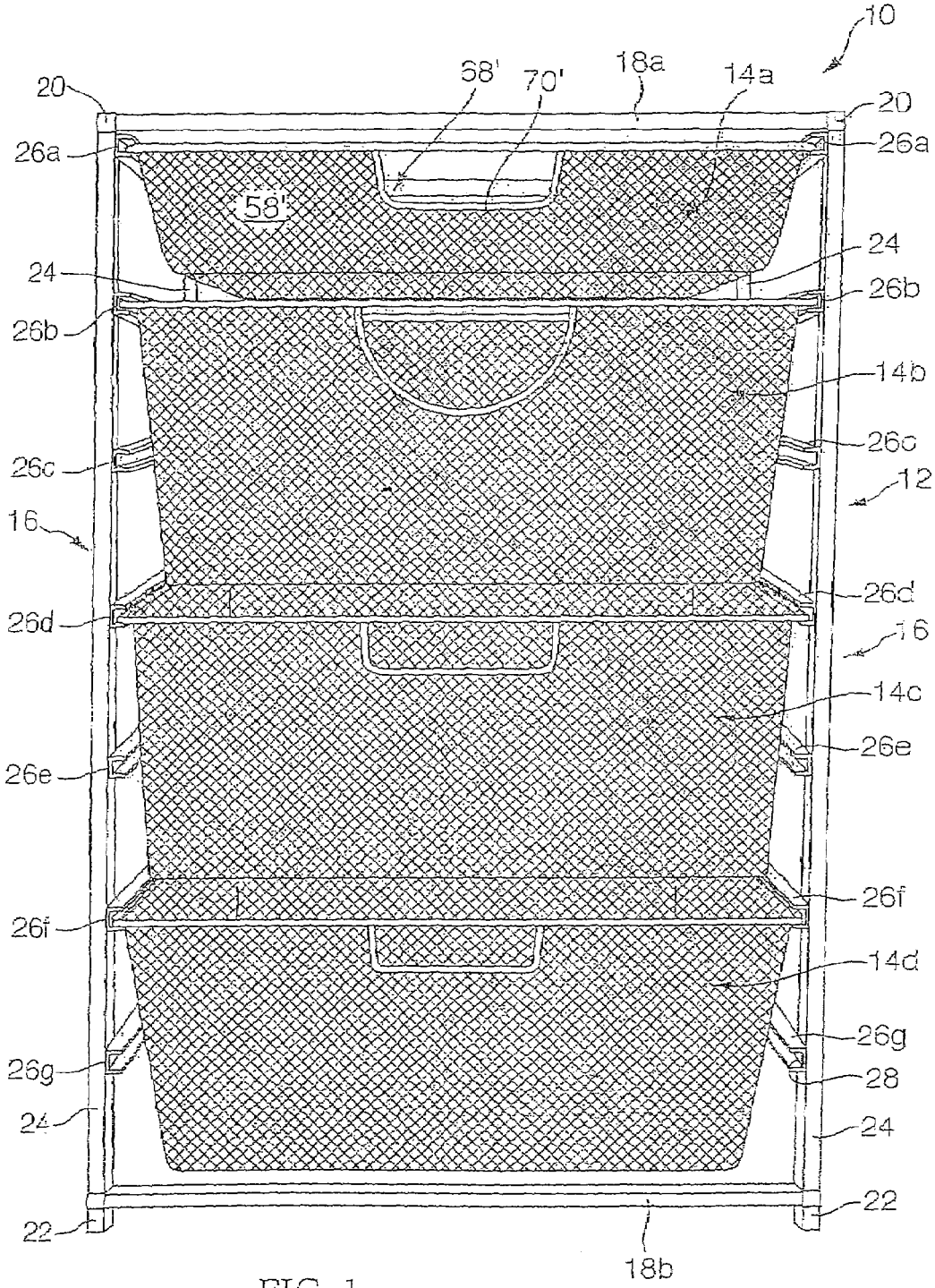
FIG. 1 is front, perspective view of a first example of a system of drawers of the present invention, where the drawers are in a retracted position.

Referring to FIG. 1, a first example of drawer system 10 is shown. This drawer system 10 may be used to store a variety of housewares, such as kitchen items, clothing, accessories, sports equipment, shoes, bathroom supplies, tools, appliances, and the like. Additionally, system 10 can be used to store a variety of other items, for example food, office supplies, office equipment, file folders, papers/documents, bags, boxes, cans, bottles, etc.

Drawer system 10 includes frame 12 and a plurality of containers or drawers 14*a-d*. Drawer 14*a* is smaller than drawers 14*b-c* so drawer 14*a* can hold a smaller volume than other drawers 14*b-d*. Drawers 14*a-d* are movable with respect to frame 12 between a retracted position (shown in FIG. 1) and an extended position. In the retracted position, the contents of lower drawers 14*b-d* is difficult to access. In the extended position, the contents of the extended drawer are easily accessible; the extended drawer may be fully withdrawn from frame 12 if desired.

With reference to FIG. 1, frame 12 includes two side frame members or ladders 16 that are spaced apart and joined by pairs of upper and lower cross members 18*a,b,* respectively. Side frame members 16 and pairs of upper and lower cross members 18*a,b* are formed to give frame 12 a rectangular shape. The present invention is not limited to this frame shape.

Figure 2A:
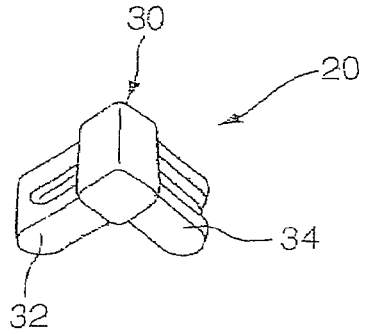
FIG. 2A is an enlarged, perspective view of an L-connector for use with the system of FIG. 1.
Figure 2B:
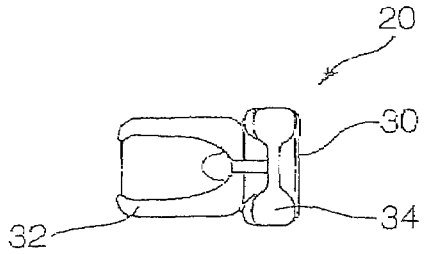
FIG. 2B is an enlarged, end view of the L-connector shown in FIG. 2A.

Frame 12 further includes L-connectors 20 (as best seen in FIG. 2A) and T-connectors 22 (as best seen in FIG. 2B) for joining side frame members 16 to cross frame members 18*a, b.* For example, L-connectors 20 connect upper cross member 18*a* to side frame members 16, if no additional frames are to be added above the one illustrated in FIG. 1. If an additional frame is to be added above frame 12 shown in FIG. 1, T-connectors 22 are used to join upper cross members 18*a* to frame members 16. For example, T-connectors 22 also connect lower cross members 18*b* to side frame members 16. Alternatively, T-connectors 22 joined to lower cross members 18*b* can be replaced with plugs with casters (not shown) thereon to make system 10 movable, as is apparent to those of ordinary skill in the art.

Referring again to FIG. 1, each side frame member 16 includes a pair of spaced apart vertical rods 24 coupled by vertically spaced apart horizontally-extending runners 26*a-g*. Each side frame member 16 is formed so that runners 26*a-g* of each side frame member 16 are aligned with runners 26*a-g* of other side frame member 16 to form a plurality of pairs of runners. Each runner 26*a-g* is a generally U-shaped member with inwardly extending gap 28 defined therein. Runners 26*a-g* may include a bore (not shown) in the rear end for receiving a pin (not shown) for preventing rearward movement of drawers 14*a-d* out of frame 12. To make frame 12 independent of direction the bore (not shown) may be formed at both ends of each runner and the pin (not shown) disposed in the desired end for use.

Frame 12 is, for example, formed of any metal with sufficient rigidity and formability, for example mild sheet steel, stainless steel, aluminum, copper or the like can be used. Vertical rods 24 and runners 26*a-g* are, for example, welded together using conventional welding techniques. Frame 12 may be subjected to a powder painting treatment, similar to that discussed below for drawers 14*a-d*.

Figure 2C:
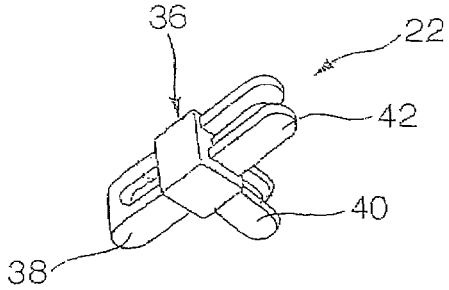
FIG. 2C is an enlarged, perspective view of a T-connector for use with the system of FIG. 1.
Figure 2D:
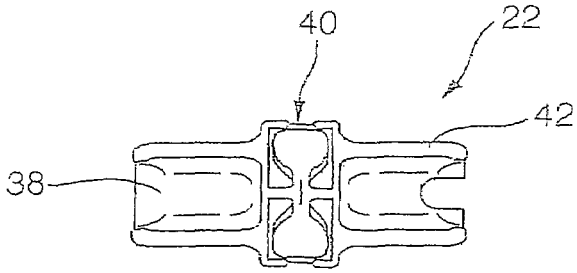
FIG. 2D is an enlarged, end view of the T-connector shown in FIG. 2C.

Referring to FIGS. 1, 2A and 2B, L-connector 20 includes central body 30 and first and second generally perpendicular legs 32 and 34 extending therefrom. For example, pairs of cross members 18*a,b* and vertical rods 24 are hollow so that legs 32 and 34 are received therein to join these components together. Referring to FIGS. 1, 2C and 2D, T-connector 22 includes central body 36 and first, second, and third legs 38, 40, and 42, respectively, extending therefrom. First and second legs 38 and 40 are generally perpendicular to one another similar to L-connector 20. Third and second legs 40 and 42 are also generally perpendicular to one another. For example, first leg 38 and third leg 42 may be inserted into hollow vertical rods 24, and second leg 40 is inserted in hollow associated cross members 18*a,b*.

L-connectors 20 and T-connectors 22 are, for example, formed of any metal with sufficient rigidity and formability. For example, connectors 20 and 22 can be cast of die-cast aluminum or any alloy, using conventional techniques known to those of ordinary skill in the art. Connectors 20 and 22, however, can also be formed of another material like injection molded plastic.

Now, with reference to FIGS. 1, 3, and 3A, the details of drawer 14*b* will be discussed. Drawer 14*b* includes a runner portion that comprises upper rail 54 and basket portion 55. Basket portion 55 is coupled to upper rail 54. In the present example, basket portion 55 is formed of expanded metal plate (i.e., sheet metal) or "mesh" and has small openings 55*a* therein. In the present specification and appended claims "mesh" means flat metal that is pierced and stretched so that no material is separated from the original raw material, as known by those of ordinary skill in the art. On the other hand, unlike mesh, punching portions of waste material out of sheet metal material forms perforated metal. For example, openings 55*a* (see FIG. 3A) in the mesh have an area less than 25.4 mm by 25.4 mm. In another example, openings 55*a* (see FIG. 3) in the mesh have an area less than 20 mm by 10 mm. In yet another example, In another example, openings 55*a* (see FIG. 3) in the mesh have an area less than 6 mm by 3 mm.

Basket portion 55, for example, is formed of any metal such as copper, steel, stainless steel or aluminum, and the like. Basket portion 55 includes bottom wall 56, a pair of spaced apart sidewalls 58 and 60, and another pair of sidewalls 62. For example, sidewalls 58, 60 and 62 are joined together to form closed curved corners 64. Sidewalls 58, 60 and 62 extend upwardly from bottom wall 56 to form upwardly-facing opening 66.

Figure 3:
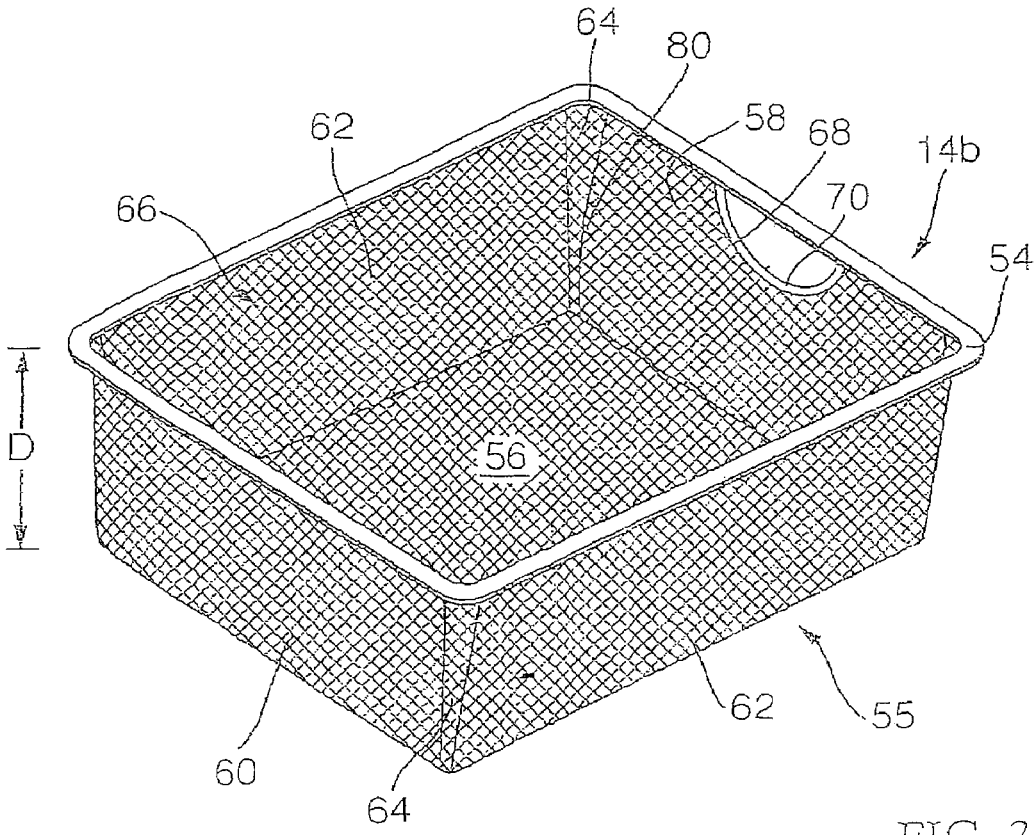
FIG. 3 is an enlarged, rear, perspective view of the first example of a drawer shown in FIG. 1.
Figure 3A:
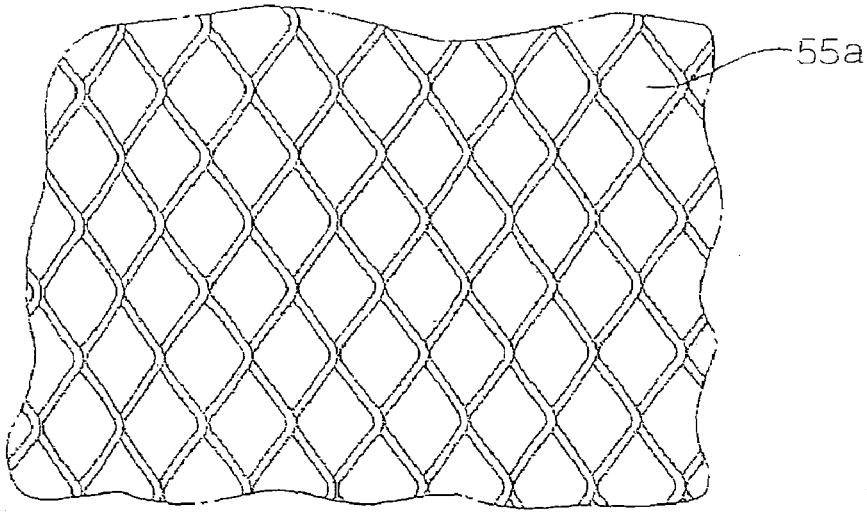
FIG. 3A is an enlarged, perspective view of a portion of the drawer shown in FIG. 3.

As shown in FIG. 3, corners 64 are curved so that they deviate from straightness in a smooth, continuous fashion. The present invention, however, is not limited to drawers with curved corners and drawers with more angular corners are also considered inventive. The present invention is also not limited to drawers with a radius of curvature greater at the top of the drawer (adjacent the rail 54) than at the bottom. Thus, drawers with, for example, a constant radius of curvature are also considered inventive.

In this example, sidewall 58 forms a front end wall that includes curved cutout 68 bordered by handle rail 70. Cutout 68 forms a place where a user can easily grasp drawer 14*b* to move it between the retracted and extended positions. In an alternative example, cutout 68 can be replaced with other methods to aid the user in moving drawer 14*b*, such as a protruding handle connected to wall 58. Handle rail 70 may have a circular cross-sectional shape and be cut and formed to extend along the edge of cutout 68. In the present example, rail 70 is of the same material as upper rail 54 and is spot-welded to basket portion 55. In this example, sidewall 60 forms a rear end wall.

Figure 4:
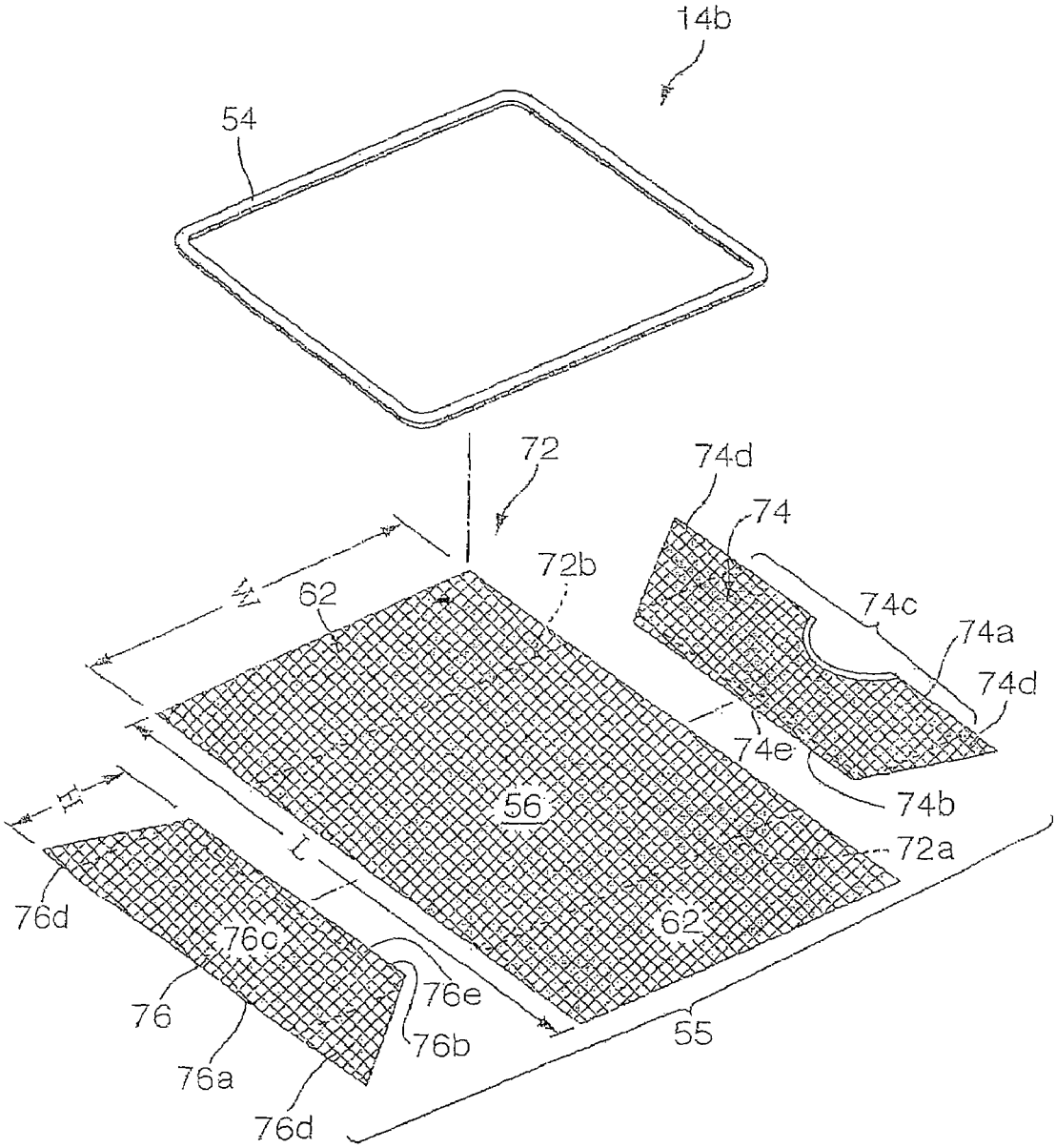
FIG. 4 is an exploded, rear, perspective view of the drawer shown in FIG. 3.
Figure 5:
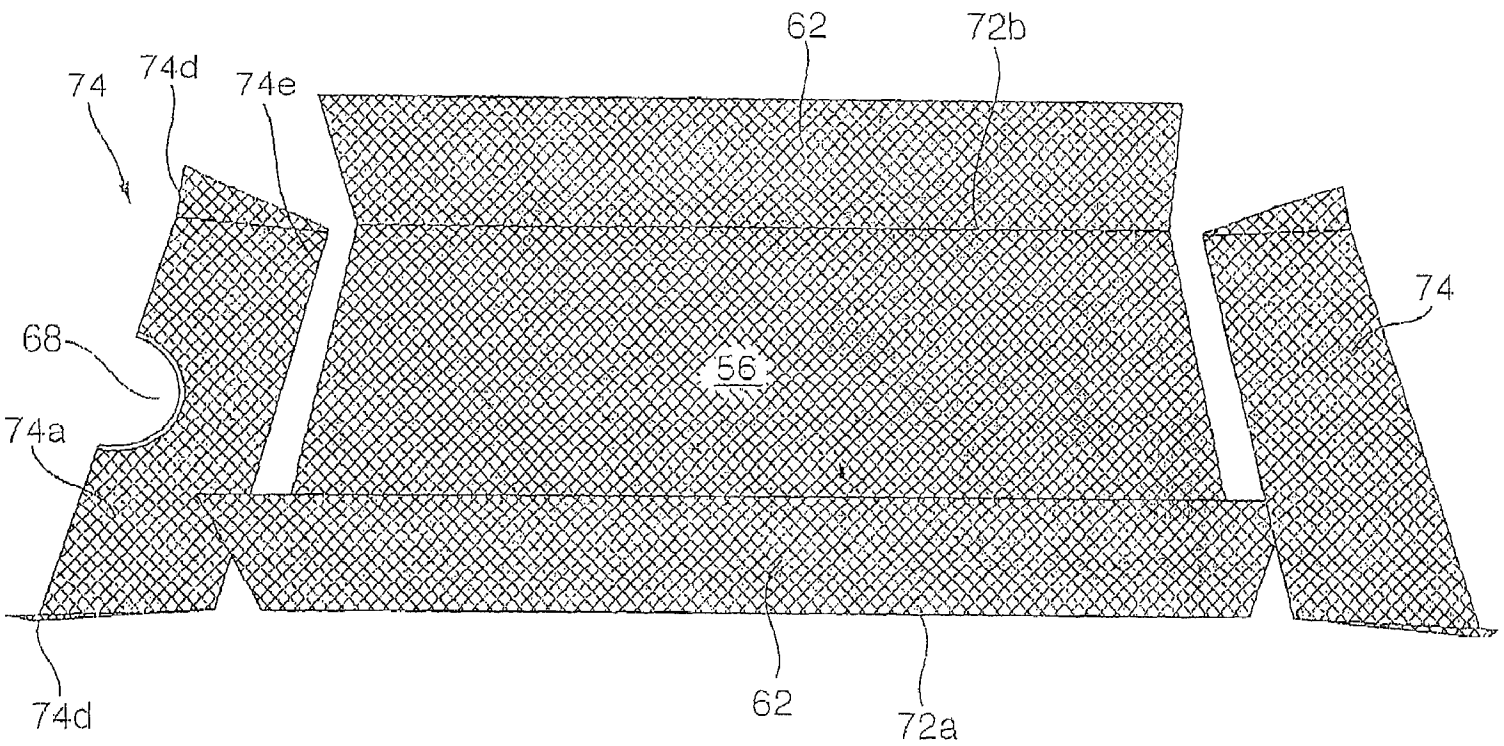
FIG. 5 is an exploded, rear, perspective view of a portion of the drawer shown in FIG. 3, wherein all of the mesh pieces have been bent.

Referring to FIG. 4, drawer 14*b* is shown in a disassembled state. Basket portion 55 is formed by first piece of mesh 72, second piece of mesh 74 and third piece of mesh 76. First, second, and third pieces of mesh 72, 74, 76 are formed separately from one another. First piece of mesh 72 is bent along lines 72*a,b* to form edges as shown in FIG. 5 to define bottom wall 56 and sidewalls 62. The angle between bottom wall 56 and sidewalls 62 is greater than about 90°, but the present invention is not limited to this configuration.

Second piece of mesh 74 includes outer edge 74*a*, inner edge 74*b*, central portion 74*c*, side extensions 74*d*, and lower extension 74*e*. Central portion 74*c* is between outer edge 74*a* and lower extension 74*e* and between side extensions 74*d*. Side extensions 74*d* have a trapezoidal shape so that they taper downward from outer edge 74*a* to lower edge 74*b*. Second piece of mesh 74 is bent to form front end wall 58, curved corners 64, and lower extension 74*e* that is generally perpendicular to front end wall 58 (see FIGS. 3 and 5). Third piece of mesh 76 is formed similarly to second piece of mesh 74 to include upper edge 76*a*, lower edge 76*b*, central portion 76*c*, side extensions 76*d*, and lower extension 76*e*.

In an alternative example, pieces of mesh 74 and 76 can be formed of a single piece of material separate from first piece of mesh 72. In such event, the two pieces of mesh 74 and 76 would be joined by another mesh segment (not shown) that would be shaped similar to bottom wall portion 56. As a result, bottom wall of basket 55 would be formed of two layers of mesh material that overlap.

Figure 5A:
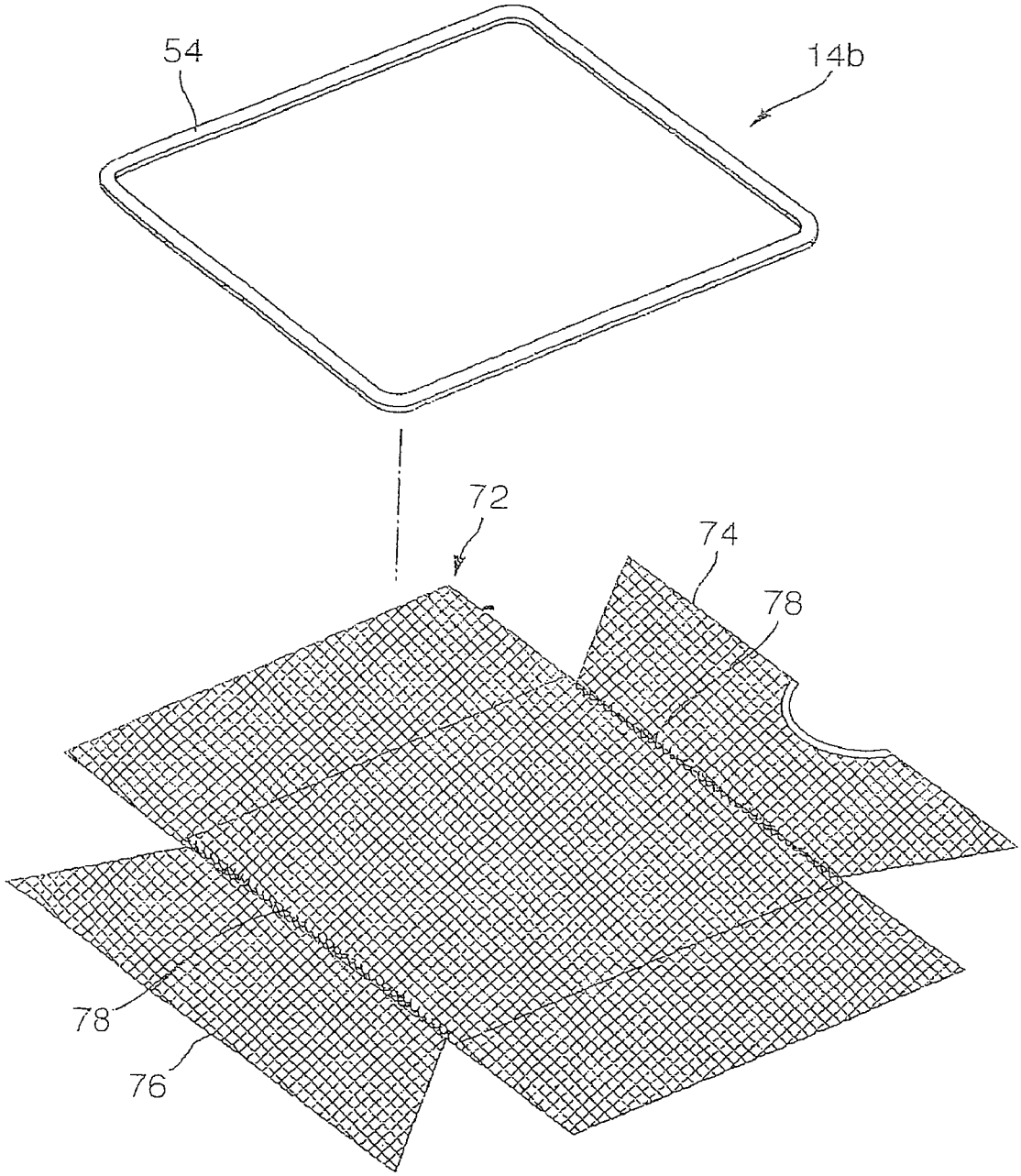
FIG. 5A is a partially-exploded, rear, perspective view of the drawer shown in FIG. 4, wherein three pieces of mesh material have been joined together.

Referring to FIG. 5A, first, second, and third pieces of mesh 72, 74, and 76 have been joined together so that bottom seams 78 are formed. Seams 78 are where the material of bottom wall 56 of first piece of mesh 72 overlaps with lower extension 74*e* of second and third pieces of mesh 74 and 76 (see FIG. 4). When corners 64 are formed, side seams 80 (as shown in FIG. 3) are formed adjacent each corner 64. Seams 80 are where the material of sidewalls 62 of first piece of mesh 72 overlaps with side extensions 74*d* and 76*d* of second and third pieces of mesh 74 and 76, respectively. Seams 80 are generally vertically extending side seams.

The method of making drawer 14*b* will now be discussed. Referring to FIGS. 4 and 5, first piece of mesh 72 is formed and shaped as shown. This involves cutting piece of mesh 72 with the desired dimensions from a roll of mesh using a conventional press machine. Then, first piece of mesh 72 is bent into a U-shape that includes bottom wall 56 and end walls 62 (as shown in FIG. 5). A conventional hydraulic press machine is used to bend mesh piece 72. The hydraulic press machine includes a mold for achieving the desired bent shape, as is known by those of ordinary skill in the art.

Second and third pieces of mesh 74 and 76 are formed and shaped as shown in FIG. 4. This involves cutting pieces of mesh 74 and 76 with the desired dimensions and shape from a roll of mesh using a conventional press machine. Then, mesh piece 74 is bent using a conventional hydraulic press machine so that side extensions 74*d* are curved and lower extension 74*e* is angularly offset from center section 74*c*. The hydraulic press machine includes a mold, as is known by those of ordinary skill in the art. Third piece of mesh 76 is bent similarly to second piece 74 (as shown in FIG. 5). Handle rail 70 may be welded to mesh piece 74 at this point or later, when upper rail 54 is joined to basket portion 55.

Next, lower extensions 74*e*,76*e* of each piece 74,76 are connected by welding to the side edge of bottom wall 56 of first piece 72 (as shown in FIG. 5A) to form seams 78. Then, curved side extensions 74*d*,76*d* of pieces 74,76 are connected by welding to sidewalls 62 of first piece 72 to form seams 80 (as shown in FIG. 3).

After drawer 14*b* is completely formed (including attaching rail 54), a process of powder painting may be used to coat drawer 14*b*, as is known by those of ordinary skill in the art. One exemplary paint is an epoxy coat. The painting may provide a decorative (colored and/or metallic) finish to drawer 14*b*, if desired, and will also provide some protection for the drawer 14*b* from water and other corrosive elements.

Figure 6:
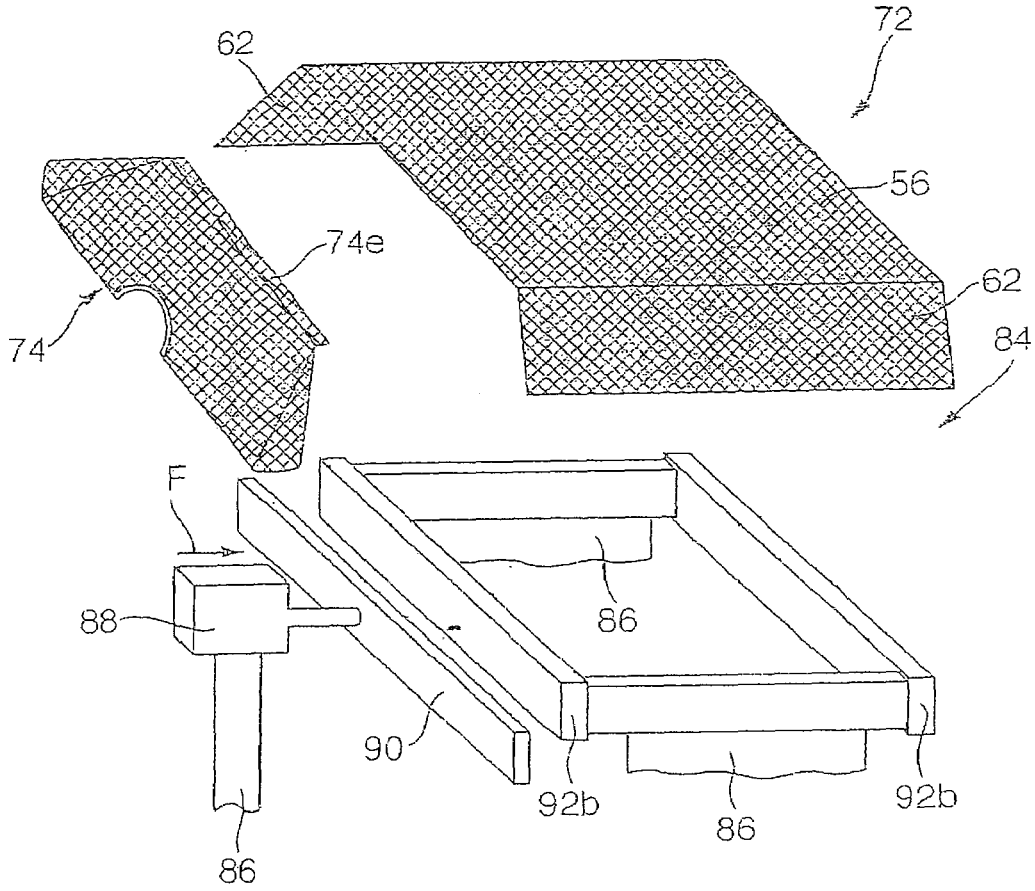
FIG. 6 is a schematic representation of some of the mesh pieces of FIG. 5 and a portion of a welding machine for joining such pieces.
Figure 7:
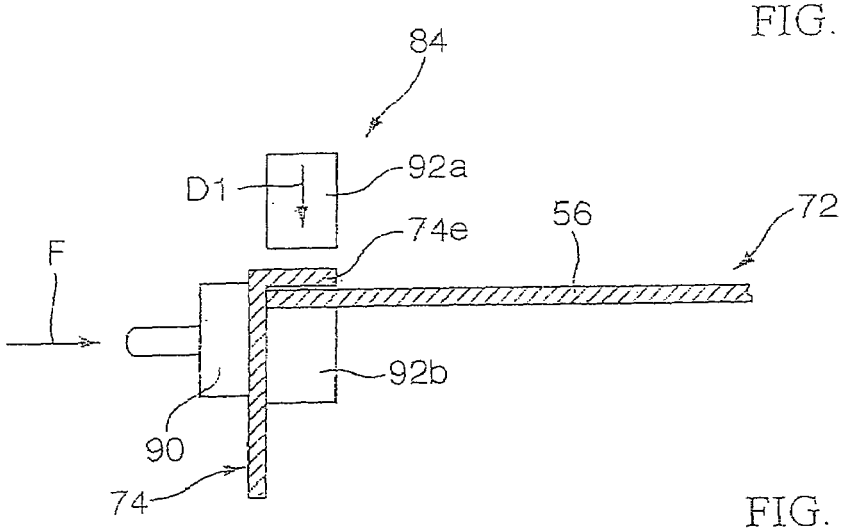
FIG. 7 is a schematic representation of some of the mesh pieces of FIG. 5 and a portion of the welding machine of FIG. 6.

Referring to FIGS. 5, 6, and 7, the equipment used to connect first, second and third pieces of mesh 72, 74, and 76 together will now be discussed. The equipment, for example, comprises spot-welding machine 84 including base 86, clamp 88 supported on base 86, movable elongated member 90 movable by clamp 88 to provide clamping force F, and a pair of anode electrodes 92*a* and a pair of cathode electrodes 92*b*. Base 86, clamp 88, member 90, and cathode electrodes 92*b* form a fixture for supporting mesh pieces 72, 74, and 76 during welding. As shown, for example, cathode electrodes 92*b* are, for example, bar-like and parallel to one another to properly support and clamp mesh pieces 72, 74, and 76. In an alternative example, the spot-welder can be used without clamp 88 and elongated member 90, where the pieces may be manually held during welding.

In order to join lower extension 74*e* of second piece 74 to bottom wall 56 of first piece 72, already-bent first piece 72 is disposed on cathode electrodes 92*b* so that sidewalls 62 extend downward (as shown in FIG. 6) toward the floor. Bent second piece 74 is disposed between member 90 and cathode electrode 92*b*, as shown in FIG. 7. Next, clamp 88 is actuated so that clamping force F moves member 90 from a retracted position (shown in FIG. 6) into a clamping position (shown in FIG. 7). In the clamping position, mesh piece 74 is compressed between member 90 and cathode electrode 92*b*. Clamping force F must be sufficient to hold mesh piece 74 into contact with mesh piece 72 for the welding operation.

Then, anode electrode 92*a* moves in direction D1 into contact with pieces 72,74 adjacent extension 74*e*. Pieces 72,74 are tightly compressed between electrodes 92*a* and 92*b*. Electrodes 92*a*,*b* then discharge electric welding current through the place to be welded and seam 78 (see FIG. 5A) is formed. Third piece 76, as shown in FIG. 5, is similarly joined to first piece 72. In the present example, welding machine 84 is properly configured so that the fixture includes two clamps, two elongated members 90 and two pairs of electrodes 92*a*,*b*. As a result, second and third pieces 74 and 76 can, for example, be simultaneously welded to first piece 72.

Another spot-welding machine similar to machine 84 is used to weld pieces 74 and 76 to piece 72 adjacent the corners 64 to form seams 80. This spot-welding machine for forming seams 80 has an appropriately sized fixture including clamp(s), elongated member(s) and cathode electrode(s) for smaller pieces 74 and 76. For example, the cathode electrode(s) may be tapered to match trapezoidal extensions 74*d*,76*d* so that pieces 74 and 76 are suitably clamped to end walls 58 and 60 during welding.

Figure 9:
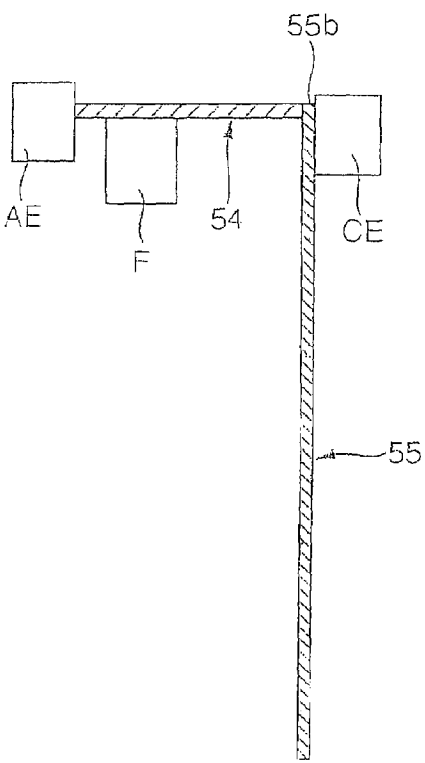
FIG. 9 is a partial, elevational view of the upper rail joined to the mesh piece of FIG. 8, wherein the upper portion of the mesh piece is cropped.
Figure 8:
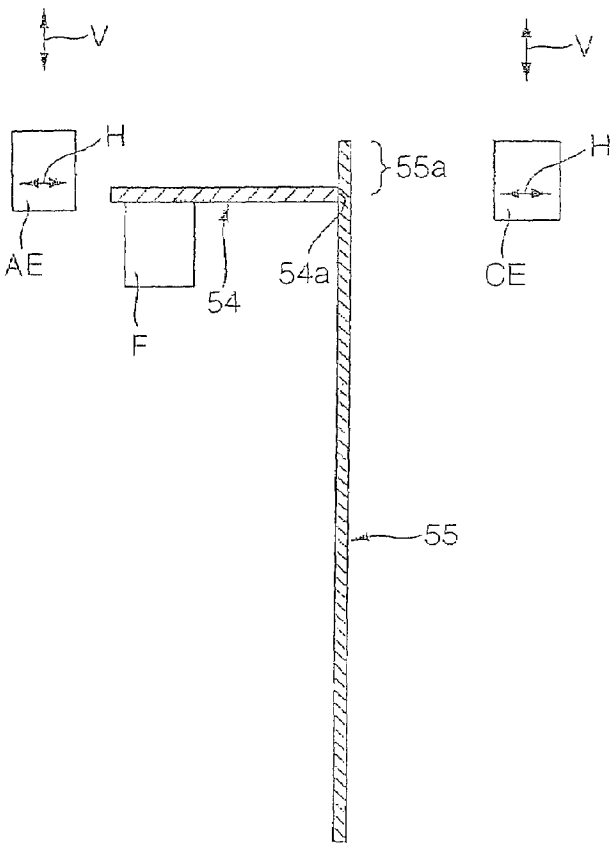
FIG. 8 is a partial, elevational view of a first example of an upper rail joined to one of the mesh pieces shown in FIG. 5, wherein an upper portion of the mesh piece is uncropped.

With reference to FIG. 3, upper rail 54 is subsequently connected to upper section of end walls 58 and 60 and sidewalls 62 by spot-welding. Referring to FIGS. 3 and 8-9, the step of connecting upper rail 54 to basket portion 55 further, for example, includes the steps of forming generally flat upper rail 54; contacting rail 54 to basket portion 55 on contact surface 54*a* so that upper section 55*a* of basket portion 55 extends above rail 54; and spot-welding contact surface 54*a* to outer surface of basket portion 55.

Upper rail 54 is, for example, formed of the same material as basket portion 55 so that these components can be welded together. Thus, for example, rail 54 is formed of any metal such as copper, steel, stainless steel, mild sheet steel or aluminum, and the like. In an example using sheet steel, a roll of sheet steel strip material with a circular cross-section is used. This material is passed through a conventional roll forming machine with a number of pairs of rollers using a predetermined compression pressure to continuously and gradually change the circular cross-section into a generally flat rectangular cross-section, as is known by those of ordinary skill in the art.

The material with the flat rectangular cross-section is then fed into a bending machine that includes spaced apart pairs of guide rollers for guiding the material through the machine and bending the material into four spaced apart right angles to form a rectangular ring. Hydraulic power can be used to provide the bending force to the associated pairs of guide rollers. Where the bending pairs of guide rollers are located, the machine further includes rollers for preventing vertical expansion of the material. Once the rectangular ring is formed, the free ends of the ring are joined by welding to form upper rail 54.

Rail 54 is not limited to the above configuration, shape and materials. For example, it can be hollow with various shapes, such as a circular cross-section. Rail 54 can also be solid with various shapes, such as a circular cross-section. Rail 54 can also be formed of a plastic that is connected to basket portion 55 by glue or adhesive, for example.

Referring to FIGS. 8 and 9, the step of contacting rail 54 to basket portion 55 on contact surface 54*a* may, for example, further include the step of using spot-welding machine with fixture F for supporting rail 54 at a sufficient elevation above a table (not shown) so that upper section 55*a* of basket portion 55 extends above rail 54. Fixture F may also provide a clamping force for assuring surface 54*a* is in solid contact with basket portion 55 or this force may be provided by movable anode and cathode electrodes AE and CE, respectively. For example, electrodes AE and CE are circular welding wheels. Anode electrode AE contacts outer surface of rail 54 and cathode electrode CE contacts inner surface of basket portion 55 adjacent surface 54*a*, as shown in FIG. 9. An electric current is discharged through electrodes AE and CE, rail 54 and basket portion 55 to spot-weld rail 54 to basket portion 55. For example, sufficient electrodes AE and CE are provided to make the welding of rail 54 to basket portion 55 efficient. Since electrodes AE and CE are movable vertically in directions V and horizontally in directions H, the spot-welder can be used to weld variously size rails and baskets together.

The step of connecting upper rail 54 may further include cutting and grinding steps. In the cutting step, upper section 55*a* (as shown in FIG. 8) of basket portion 55 is severed using a conventional severing apparatus, such as one including a reciprocating saw blade. In the grinding step, exposed upper edge 55*b* (FIG. 9) of basket portion 55 is worked using a conventional grinding machine so that upper edge 55*b* becomes smooth. Rail 54 aids in providing structural rigidity to basket portion 55 and is the only rail circumscribing each drawer's perimeter.

Once rail 54 is joined to the outer surface of the basket portion, a substantial portion of rail 54 extends substantially outwardly from the outer surface of first, second, third and fourth sidewalls of basket portion 55 and rail 54 extends continuously around the outer surface of basket portion 55 (as shown in FIG. 3).

Referring to FIGS. 1 and 3, in use drawer 14*b* is inserted into system 10 by disposing upper rail 54 within gap 28 of opposed, aligned pair of runners 26*b*. Rail 54 and gap 28 are sized to allow free sliding movement of drawer 14*b* with respect to frame 12 between the retracted and extended positions.

Since drawer 14*b* is formed of mesh with very small openings 55*a* (see FIG. 3), small objects, such as pens, paper clips, and the like, can be stored in drawer 14*b* without a liner and will not fall through openings 55*a*. In addition, since drawer 14*b* has closed corners 64, small objects also cannot fall out of this area of drawer 14*b*.

As shown in FIG. 1, drawers 14*b*-14*d* are of medium size and vertically extend across two sets of vertically spaced runners. Drawer 14*a* is a small size and consequently extends across only one set of vertically spaced runners. The drawers may be sized differently, see FIG. 4, particularly by changing the length L of first piece of mesh 72 and the height H of second and third pieces of mesh 74 and 76. This allows containers of a variety of sizes to be formed without excess machinery costs, particularly large containers having depth D from bottom wall 56 to top surface of top rail 54 (see FIG. 3) equal to or greater than about 11 inches. If larger baskets are desired, the basket material may need to be changed and/or thickened to provide more rigidity thereto. Width W of the mesh (FIG. 4) can be set by the machine forming the raw material so that the edges of piece 72 that will be connected to pieces 74 and 76 are smooth and require no cutting or grinding.

Figure 11:
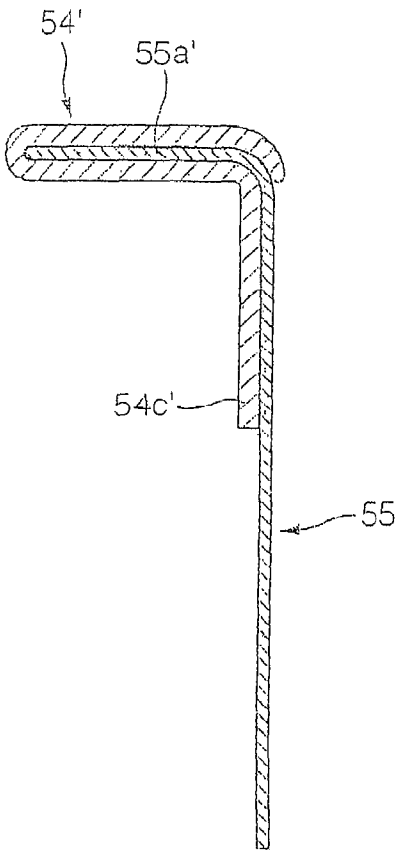
FIG. 11 is a partial, elevational view of the upper rail joined to the mesh piece of FIG. 10.
Figure 10:
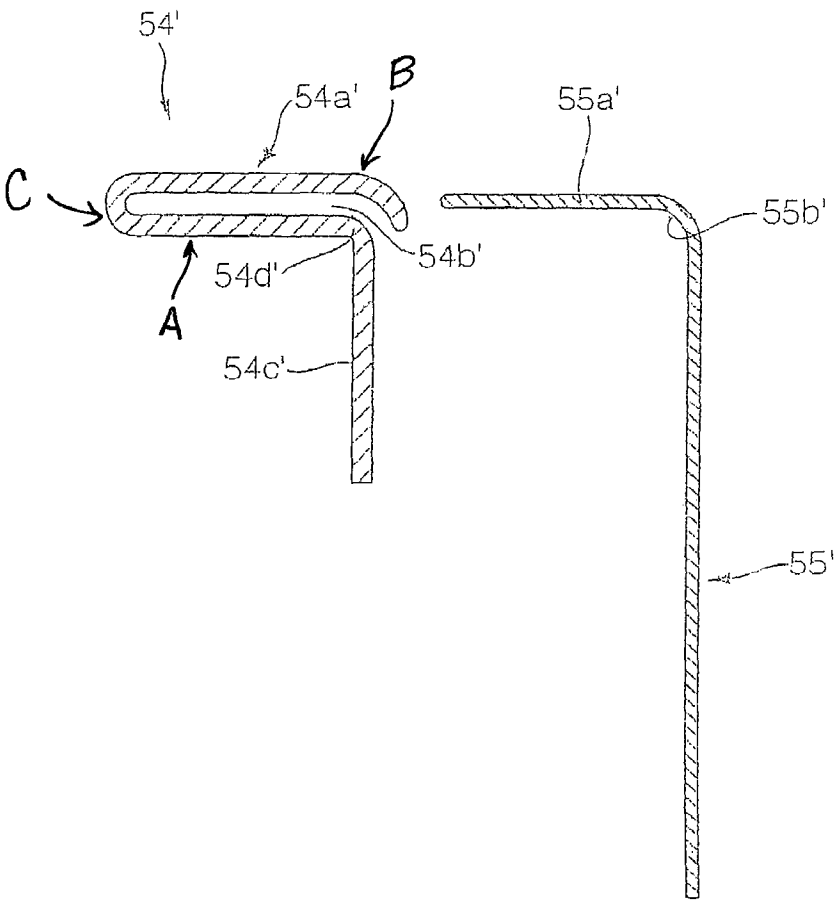
FIG. 10 is a partial, elevational view of a second example of an upper rail separated from a mesh piece.
Figure 12:
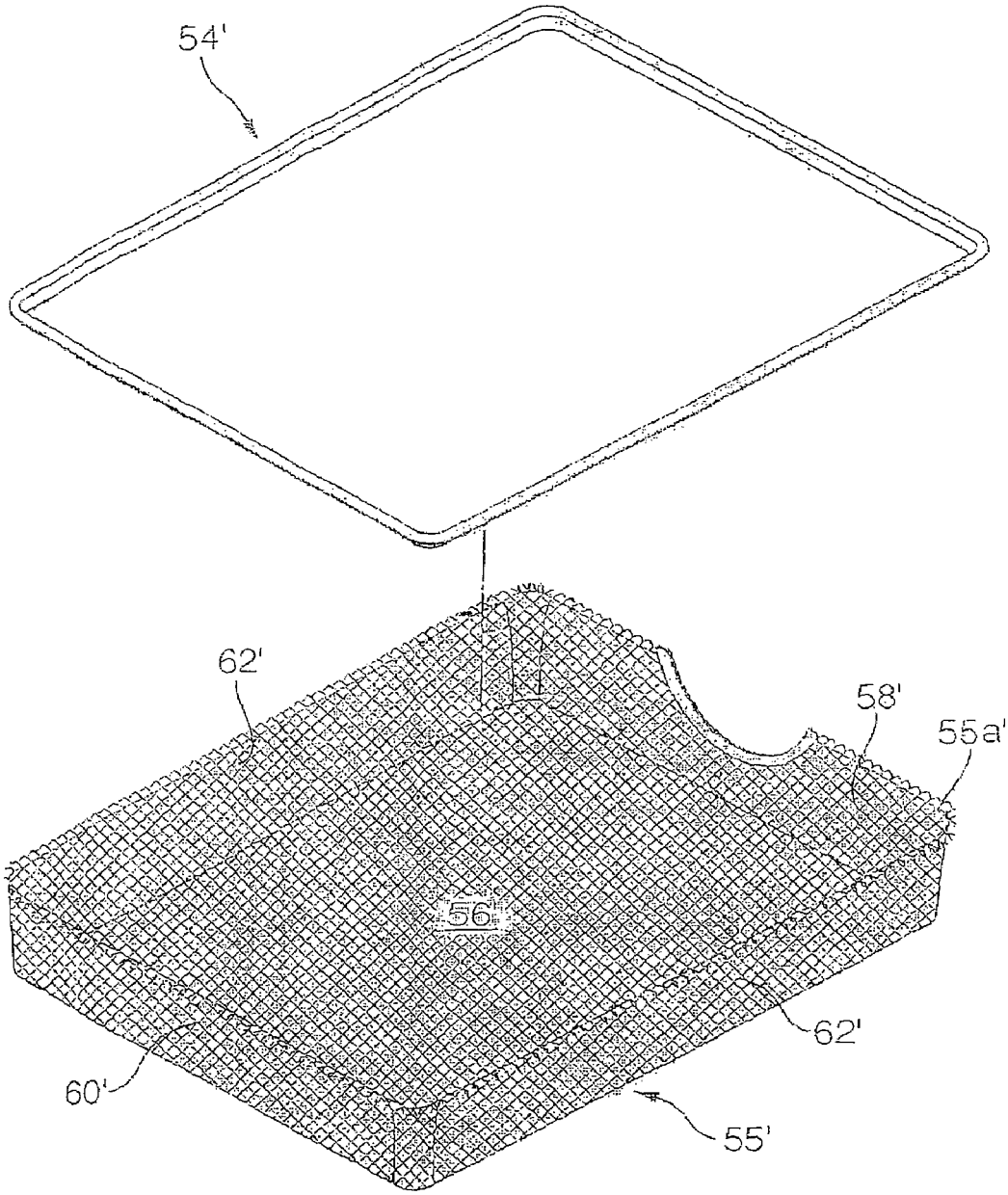
FIG. 12 is an exploded, rear, perspective view of a second example of a drawer using the upper rail and mesh piece shown in FIGS. 10 and 11.

FIGS. 10-12 illustrate an alternative example of upper rail 54' for use with alternative example of basket portion 55'. To form upper rail 54' raw material is bent to include curved portion 54*a*' with opening 54*b*' and extension 54*c*' angularly offset from curved portion 54*a*' using a roll forming machine. Curved portion 54*a*' further includes first section A, second section B, and curved section C joining first and second sections A,B so that opening 54*b*' is located therein. Sections A and B are generally horizontal sections. Extension 54*c*' is joined to first section A via curved section 54*d*'. The material for rail 54' is bent into a closed rectangular loop and welded together, similar to rail 54 so that rail 54' is continuous.

Basket portion 55' is formed similarly to basket portion 55 except end walls 58, 60 and sidewalls 62 all have an outwardly bent upper section 55*a*'. Upper section 55*a*' is formed by a conventional hydraulic press machine with a mold at the same time other bends are formed in pieces 72, 74, 76 (see FIG. 5). That is when piece 72 is bent to form edges 72*a* and 72*b*, piece 72 is also bent to form upper section 55*a*'. Similarly, upper section 55*a*' is formed on pieces 74 and 76, when edges 74*d* and 74*e* and edges 76*e* and 76*d*, respectively, are formed. Then, pieces 72, 74, 76 are welded together.

Bent upper section 55*a*' is inserted into opening 54*b*' of upper rail 54' (as shown in FIG. 11). Curved portion 54*a*' is then compressed by a conventional press machine so that opening 54*b*' is minimized and curved portion 54*a*' tightly engages basket portion 55*a*' so that inner surfaces of curved portion 54*a*' contact basket portion 55*a*'. This step also results in front curved tip or portion 54*d*' of rail 54' engaging angled corner 55*b*' of basket portion 55'. Then, vertically-extending extension 54*c*' is welded to the basket using a spot-welding machine and fixture similar to the method used for rail 54 (shown in FIGS. 8 and 9).

Once upper rail 54' is joined to basket portion 55' in this manner, it provides additional structural rigidity to basket portion 55'. Using rail 54' eliminates the need to cut upper section 55*a* of basket portion 55, as when using rail 54, as shown in FIGS. 8 and 9. Consequently, rail 54' eliminates the need to deburr or grind basket portion 55'.

In an alternative exemplary method, pieces 72, 74, 76 (see FIG. 5) are bent to form edges 72*a* and 72*b* in piece 72, edges 74*d* and 74*e* in piece 74, and edges 76*e* and 76*d* in piece 76. Then, pieces 72, 74, 76 are welded together. Next, joined pieces 72, 74, and 76 are placed in a conventional hydraulic press machine with a mold and bent to create outwardly bent upper section 55*a*' on each piece 72, 74, 76. Subsequently, rail 54' is coupled to basket 55' as previously discussed.

Referring back to FIG. 1, basket 14*a* includes a rectangular cutout 68' on front of wall 58'. Metal handle rail 70' covers the free end of the mesh within cutout 68'. Handle rail 70' is, for example, formed similar to rail 54' (ee FIG. 10) with an opening that is compressed about the mesh, once the mesh is inserted therein. For example, handle rail 70' also includes an extension, similar to extension 54*c*' of rail 54', that can be spot-welded to securely attach rail 70' to the mesh. In such an example, opening in rail 70' extends vertically along with its extension similar to extension 54*c*'. In an example of handle rail 70' without such an extension, rail 70' may still be spot-welded to the mesh.

Figure 13:
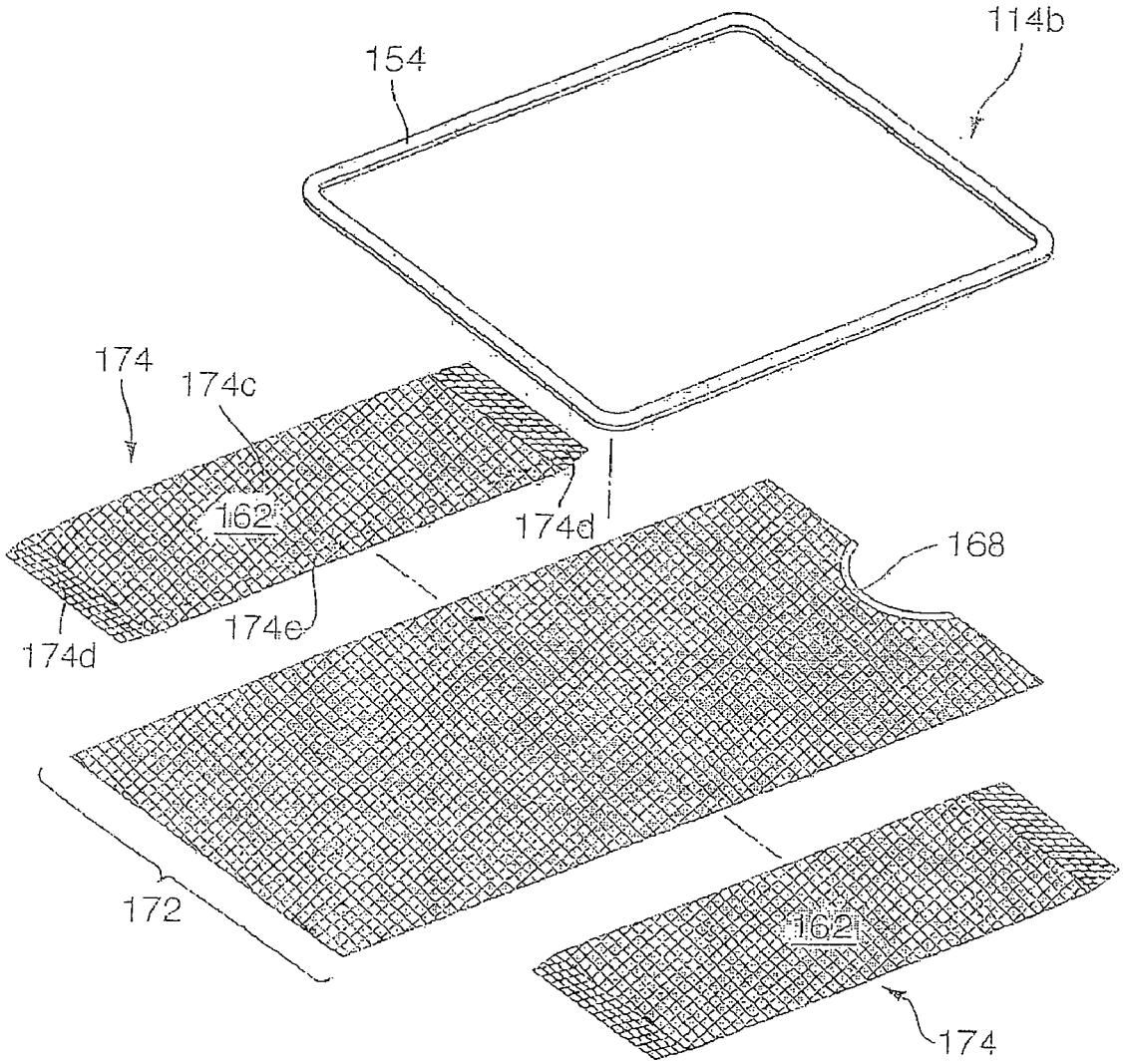
FIG. 13 is an exploded, rear, perspective view of a third example of a drawer for use in the system of FIG. 1, wherein an alternative example of two side pieces of mesh material are used.
Figure 14:
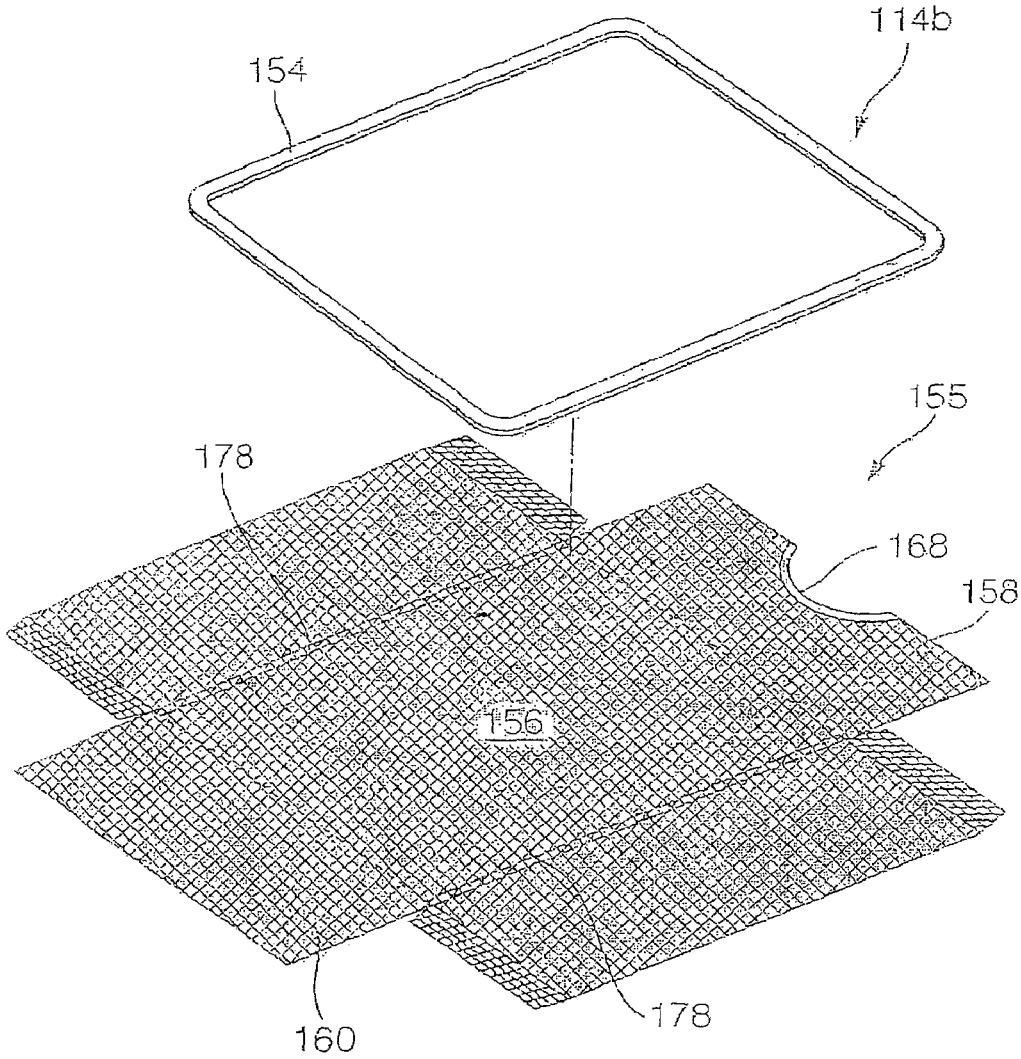
FIG. 14 is a partially-exploded, rear, perspective view of the drawer shown in FIG. 13, wherein three pieces of mesh material have been joined together.

Referring to FIGS. 13-14, third drawer example 114*b* is shown. Drawer 114*b* comprises runner portion or upper rail 154 and basket portion 155. Upper rail 154 may be formed like rail 54 or rail 54' previously discussed. Basket portion 155 includes bottom wall 156, end walls 158 and 160, and sidewalls 162. Bottom and end walls 156 and 158 are also sidewalls. First piece of mesh 172 is bent to form bottom wall 156 and end walls 158 and 160. Sidewalls 162 are formed of separate second and third pieces of mesh 174 and 176, respectively. End wall 158 includes first piece of mesh 172 with cutout 168 similar to end wall 58.

For drawer 114*b*, different from drawer 14*b*, second piece of mesh 174 includes central portion 174*c*, rectangular side extensions 174*d* and lower extension 174*e*. Third piece of mesh 176 has a similar configuration. When pieces 172, 174 and 176 are connected using a method similar to that used in forming drawer 14*b*, drawer 114*b* has closed smoothly curved corners similar to corners 64 (as shown in FIG. 3), but corners of drawer 114*b* will have a substantially constant radius. Drawer 114*b* also includes four side seams 80 at each corner and two bottom seams 178.

Figure 15:
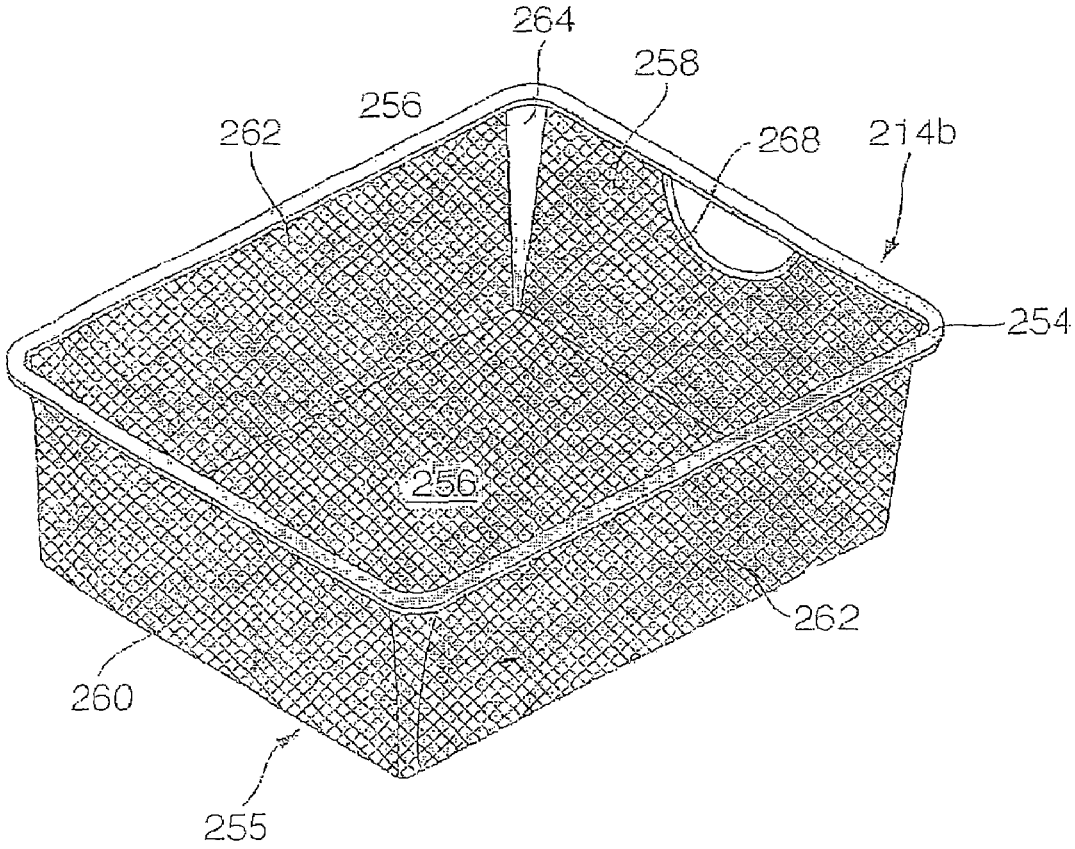
FIG. 15 is an enlarged, rear, perspective view of a fourth example of a drawer useful in the system of FIG. 1.
Figure 16:
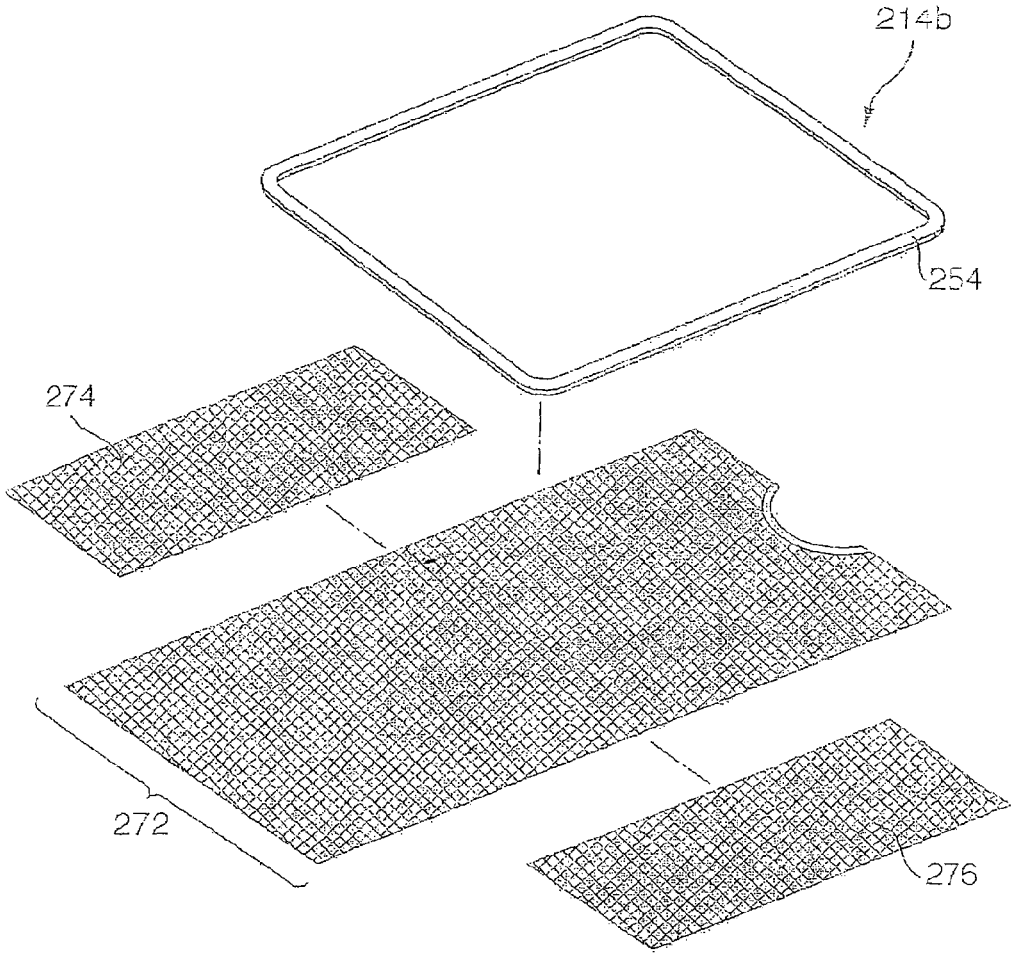
FIG. 16 is an exploded, rear, perspective view of the drawer shown in FIG. 15.
Figure 17:
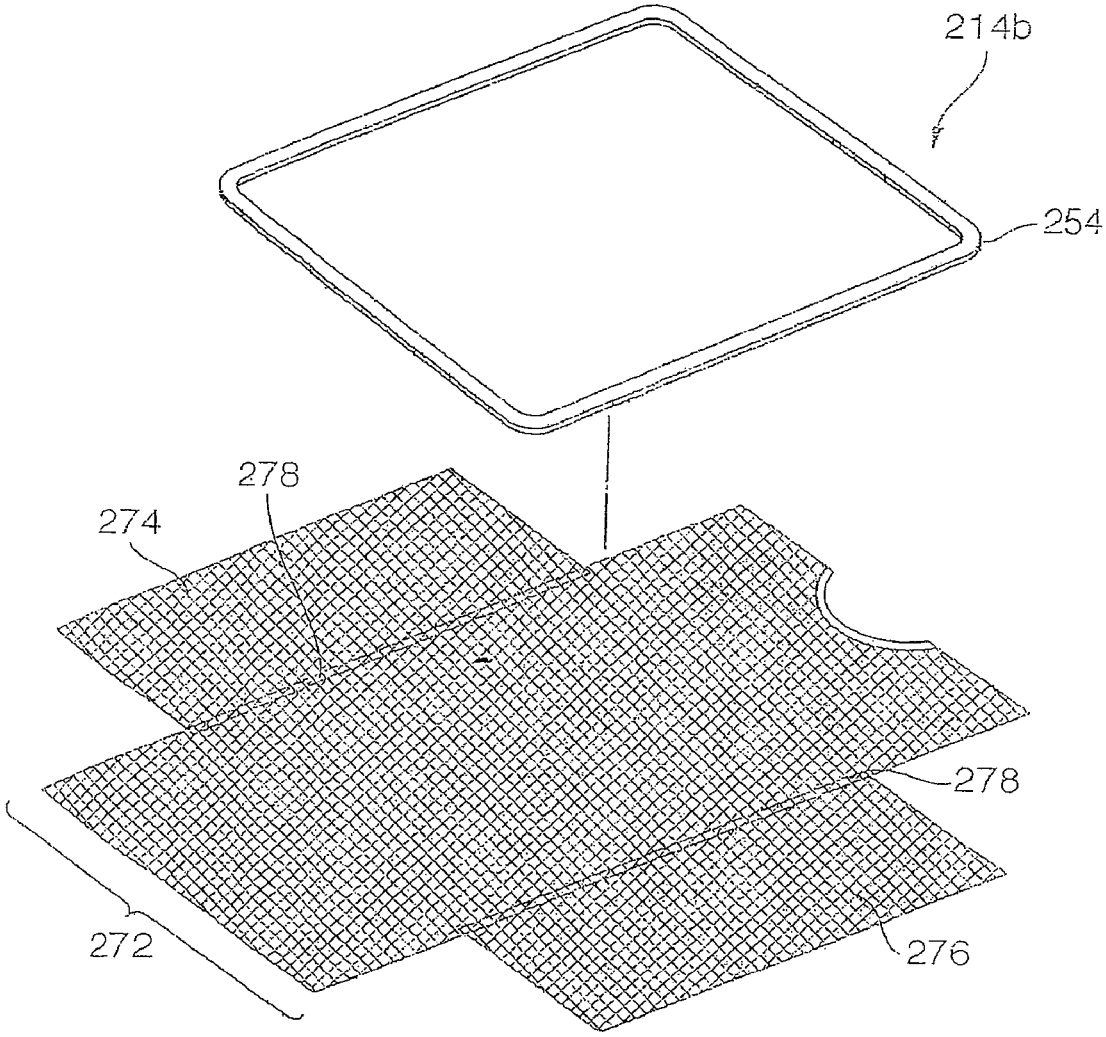
FIG. 17 is a partially-exploded, rear, perspective view of the drawer shown in FIG. 15, wherein three pieces of mesh material have been joined together.

Referring to FIGS. 15-17, fourth drawer example 214*b* is shown. Drawer 214*b* comprises runner portion or upper rail 254 and basket portion 255. Upper rail 254 may be formed like rails 54, 54', 154' or 254' discussed above. Basket portion 255 includes bottom wall 256, end walls 258 and 260, and sidewalls 262. End walls 258 and 260 are also sidewalls. First piece of mesh 272 is bent to form bottom wall 256 and end walls 258 and 260. Sidewalls 262 are formed of separate second and third pieces of mesh 274 and 276. End wall 258 includes cutout 268 similar to end wall 58.

In drawer 214*b*, different from drawers 14*b* and 114*b*, second and third pieces of mesh 274 and 276 do not include extensions. When pieces 272, 274 and 276 are connected using the method of forming drawer 14*b*, pieces 274 and 276 only overlap piece 272 on the bottom not on the sides. As a result, drawer 214*b* has open corners 264 (as shown in FIG. 15) and two bottom seams 278. Drawers configured like drawer 214*b* can be used in systems like system 10 (shown in FIG. 1) and move between extended and retracted positions. Drawers similar to drawer 214*b* can come in a number of sizes. Drawer 214*b* is formed similarly to drawer 14*b* by bending and spot-welding the mesh pieces.

Figure 18:
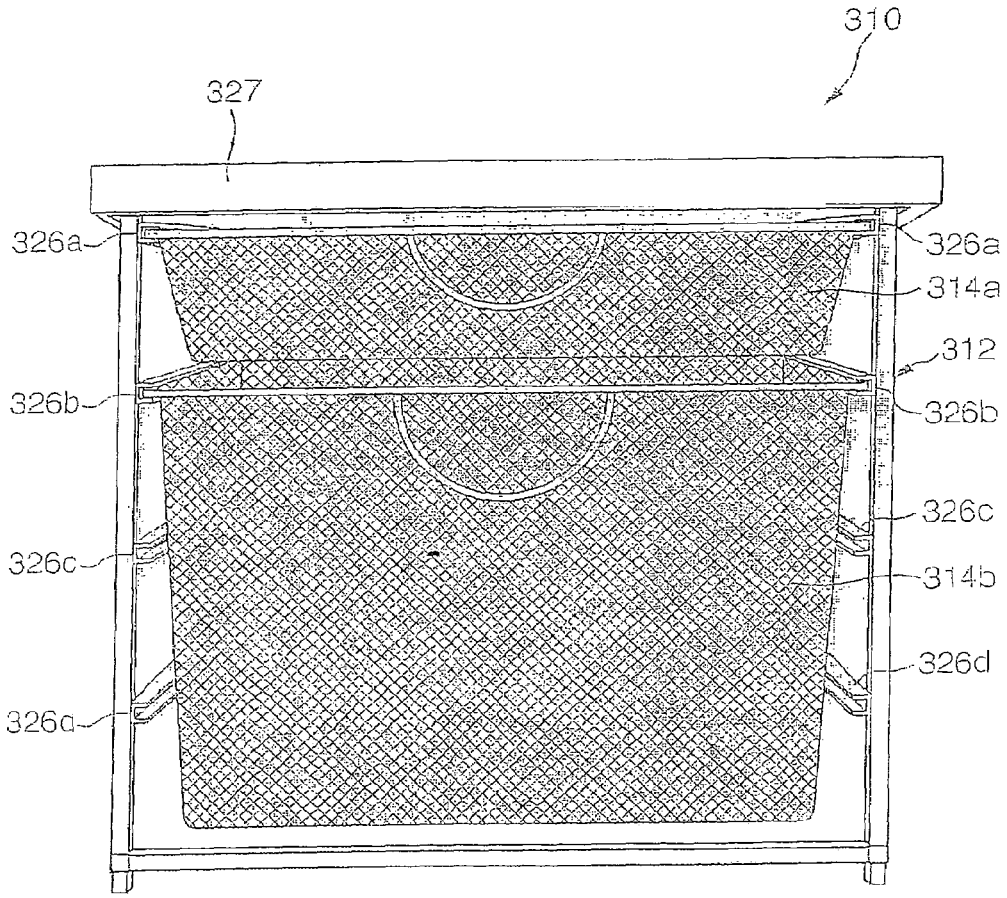
FIG. 18 is front, perspective view of a second example of a system of drawers of the present invention, where the drawers are shown in a retracted position.
Figure 20:
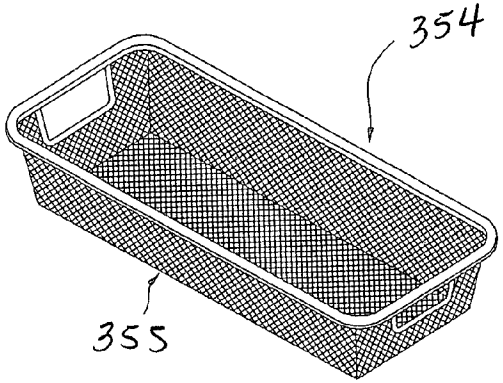
FIG. 20 is a perspective view of the drawer and rail of FIG. 19, wherein the rail is coupled to the drawer.

Referring to FIG. 18, a second example of drawer system 310 is shown. Drawer system 310 includes frame 312 and plurality of drawers 314*a* and 314*b*. Frame 312 includes four pairs of runners 326*a-d*. This example illustrates that any number of pairs of runners can be used depending on how large a system is desired. Frame 312 is otherwise configured and formed similarly to frame 12 (shown in FIG. 1). System 310 further may include solid table top or shelf 327 that is securely connected to the top of frame 312 by a press fit so that objects can be stored or displayed thereon. Alternatively, shelf 327 may be sized differently (larger or smaller than) frame 312 and connected to frame 312 with conventional fasteners such as screws and L-brackets. Drawer 314*a* is small and extends across one pair of runners 326*a*. Drawer 314*b* is large and extends vertically across three pairs of runners 326*b-d*. Drawers 314*a* and 314*b* are configured and manufactured similar to drawer 14*b* (see FIG. 1), but drawers configured like drawers 114*b* and 214*b* can also be used with system 310.

Figure 21:
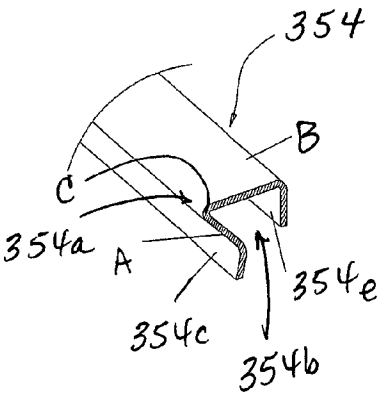
FIG. 21 is an enlarged, partial, perspective view of the upper rail of FIG. 19, wherein the rail is uncompressed.
Figure 19:
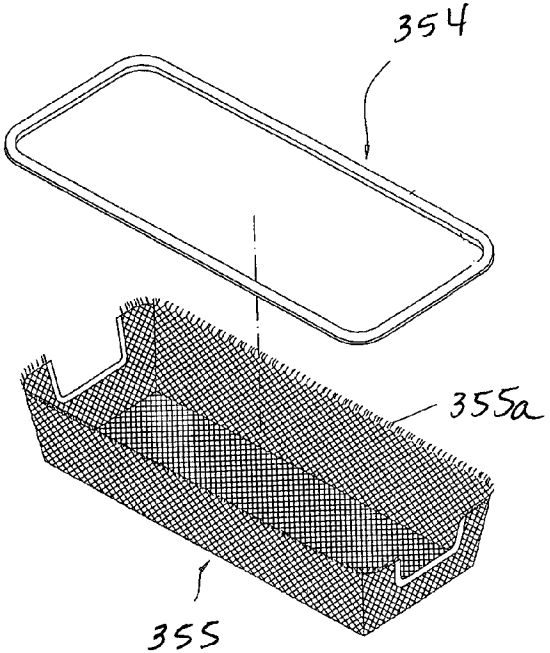
FIG. 19 is an exploded, perspective view of an exemplary drawer with a third example of an upper rail.

FIGS. 19-23 illustrate an alternative third example of upper rail 354 for use with basket portion 355. As shown in FIG. 21, upper rail 354 is formed similar to rail 54' to include curved portion 354*a* with opening 354*b* and first and second extensions 354*c* and 354*e* angularly offset from curved portion 354*a*. Curved portion 354*a* further includes first section A, second section B, and curved section C joining first and second sections A, B so that opening 354*b* is located therein. In the present example, first section A has a length less than second section B. First extension 354*c* is joined to first section A. Second extension 354*e* is joined to second section B. Rail 354 is bent so that curved portion 354*a* has a generally V-shape form, as shown in FIG. 21.

Figure 23:
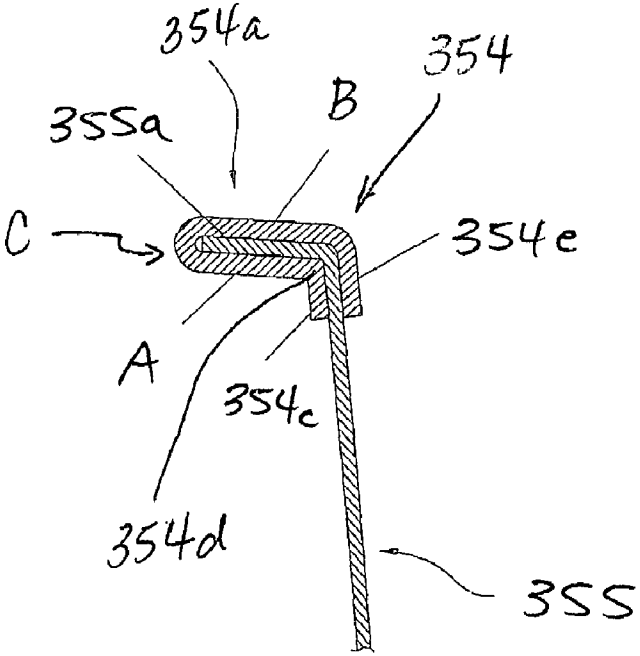
FIG. 23 is a partial, elevational view of the upper rail joined to the mesh piece of FIG. 22, wherein the rail is compressed.
Figure 22:
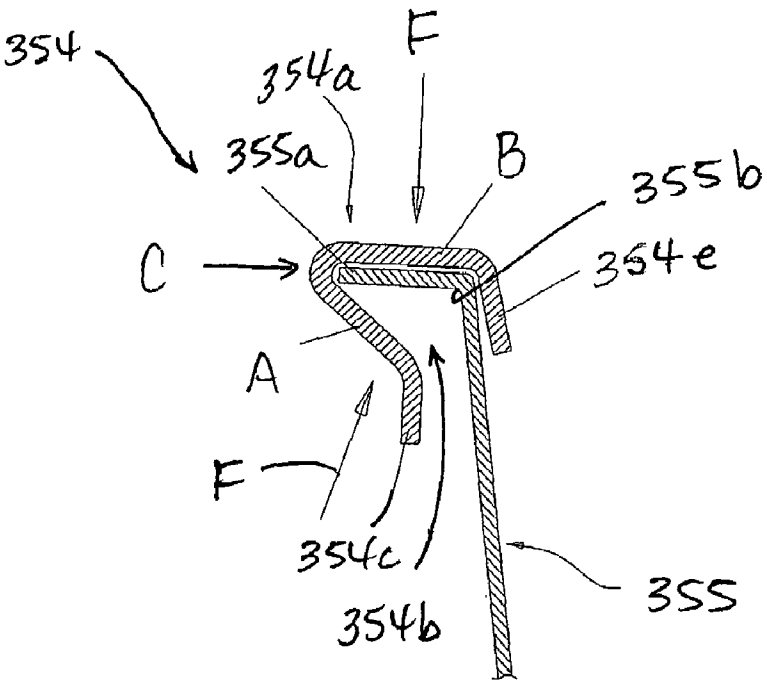
FIG. 22 is a partial, elevational view of the upper rail of FIG. 19 disposed upon a mesh piece, wherein the rail is uncompressed.

Referring to FIGS. 22 and 23, bent upper section 355*a* of basket portion 355, which is similar to basket portion 55', is inserted into opening 354*b* of upper rail 354'. As a result, first and second extensions 354*c* and 354*e* are adjacent to outer and inner surfaces, respectively, of basket portion 355. Curved portion 354*a* is then compressed, as indicated by arrows F in FIG. 22, by a conventional press machine. As a result, opening 354*b* is minimized (as shown in FIG. 23) and curved portion 354*a* tightly engages basket portion 355*a*. This compression also result in extensions 354*c* and 354*e* sandwiching basket portion 355 therebetween. Additionally after compression, extensions 354*c*, 354*e* are generally vertically oriented and first and second sections A,B are generally horizontally oriented (as best shown in FIG. 23). In addition, compression results in curved edge 354*d* of rail 354 engaging angled corner 355*b* of basket portion 355 (see FIGS. 22-23). Then, the now generally vertically-extending extensions 354*c* and 354*e* are welded to outer and inner surfaces, respectively, of basket portion 355 using a spot-welding machine and fixture similar to the method used for rail 54 (shown in FIGS. 8 and 9).

Rail 354 adds structural rigidity to basket portion 355 and eliminates the need to cut and deburr basket portion 355.

Figure 25:
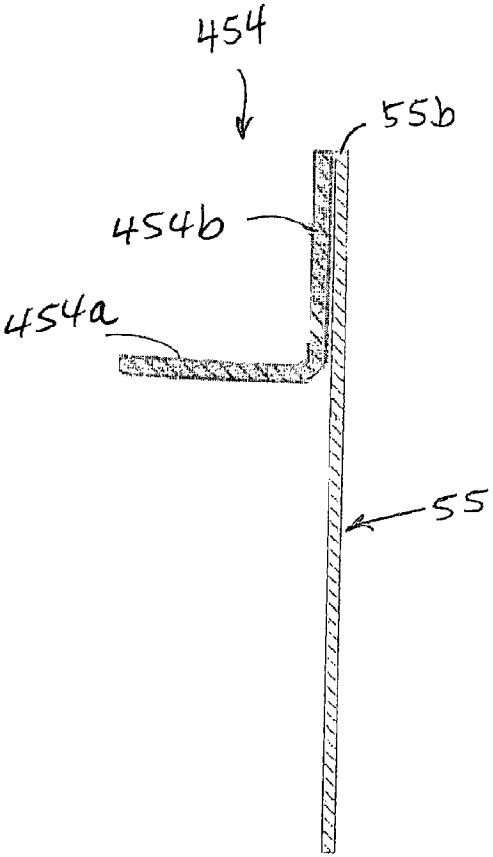
FIG. 25 is a partial, elevational view of the upper rail joined to the mesh piece of FIG. 24.
Figure 24:
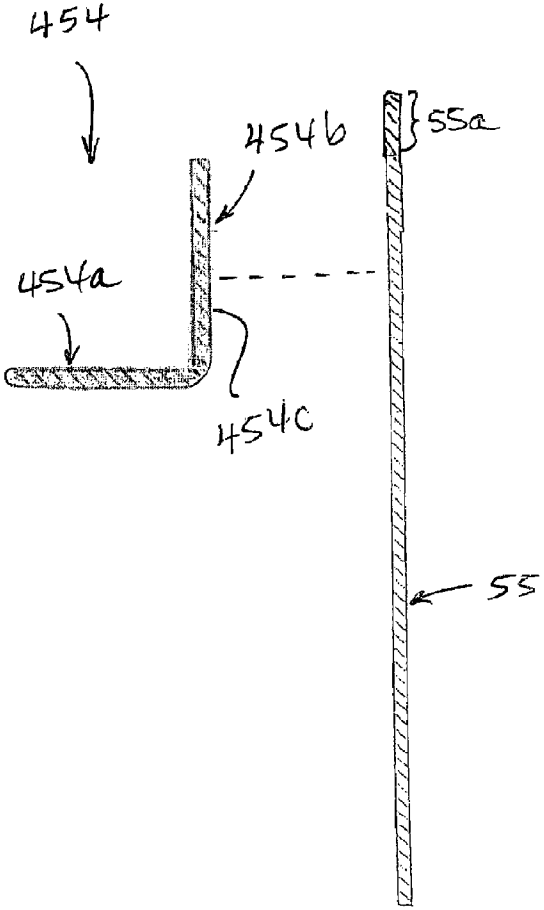
FIG. 24 is a partial, elevational view of a fourth example of an upper rail separated from a mesh piece.

FIGS. 24-25 illustrate an alternative fourth example of upper rail 454 for use with basket portion 55 (shown in FIGS. 8 and 24). Rail 454 is similar to rail 54' as shown in FIG. 10 except as discussed below. Upper rail 454 is bent to include first portion 454*a* and angularly offset second portion 454*b*. Second portion 454*b* includes contact surface 454*c*.

Second portion 454*b* of rail 454 is connected to basket portion 55 by spot-welding, similar to rail 54 shown in FIGS. 8 and 9. The step of connecting upper rail 454 to basket portion 55 further includes, for example, the steps of forming generally L-shaped rail 454, contacting contact surface 454*c* of rail 454 to basket portion 55 so that upper section 55*a* of basket portion 55 extends above rail 454 and first portion 454*a* is spaced from upper edge 55*b*, spot-welding contact surface 454*c* to outer surface of basket portion 55 (as shown in FIG. 25), and cutting upper section 55*a* of basket portion 55. A finishing or grinding step may be used to assure that upper edge 55*b* of basket portion 55 is not sharp. Alternatively, rail 454 can be joined to basket portion 55 so that free end of portion 454*b* is aligned with edge 55*b*. As a result, no additional cutting of basket portion is necessary. First portion 454*a* of the rail is operatively associated with runners 26*a-g* of frame 12 (see FIG. 1) during use.

Figure 27:
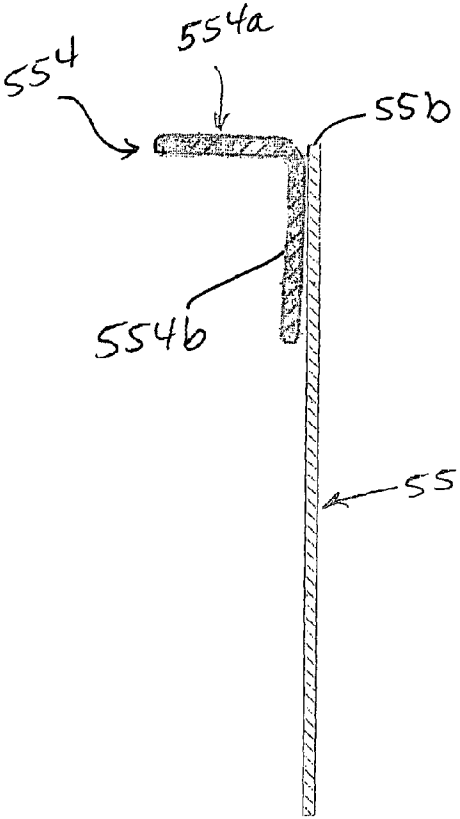
FIG. 27 is a partial, elevational view of the upper rail joined to the mesh piece of FIG. 26.
Figure 26:
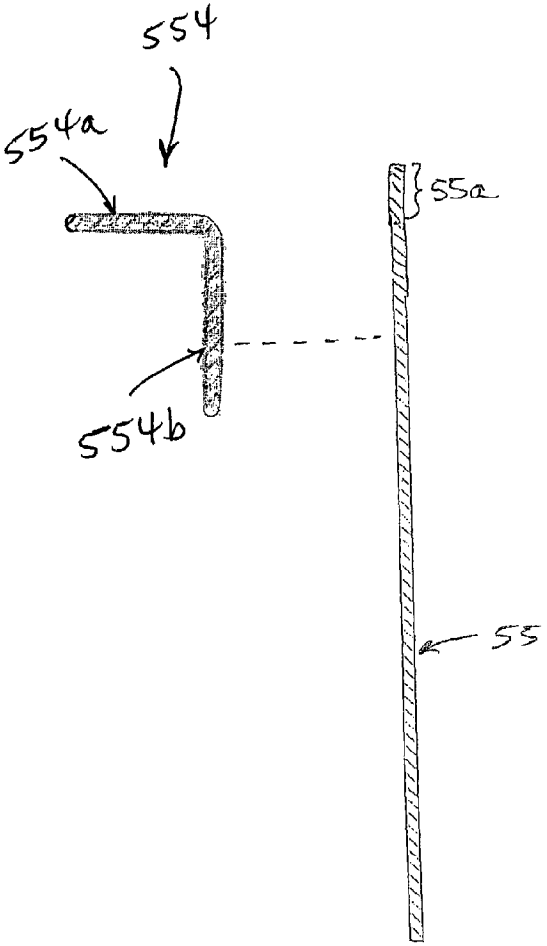
FIG. 26 is a partial, elevational view of a fifth example of an upper rail separated from a mesh piece.

FIGS. 26-27 illustrate an alternative fifth example of upper rail 554 for use with basket portion 55 (shown in FIGS. 3 and 26). Upper rail 554 is similar to upper rail 454 except rail 554 is oriented differently when joined to basket portion 55. As shown in FIG. 27, when rail 554 is joined to basket portion 55, first portion 554*a* is aligned with upper edge 55*b* and second portion 554*b* is coupled to basket portion 55. Rail 554 is joined to basket portion 55 as previously discussed with respect to rail 454. Rail portion 554*a* is operatively associated with runners 26*a-g* of frame 12 (see FIG. 1) during use.

Figure 29:
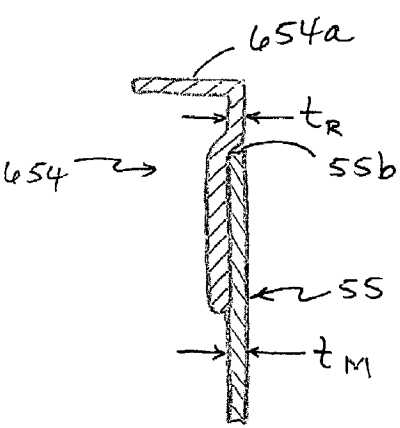
FIG. 29 is a partial, elevational view of the upper rail joined to the mesh piece of FIG. 28.
Figure 28:
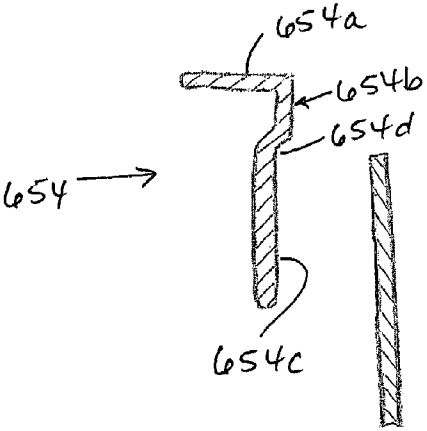
FIG. 28 is a partial, elevational view of a sixth example of an upper rail separated from a mesh piece.
Figure 31:
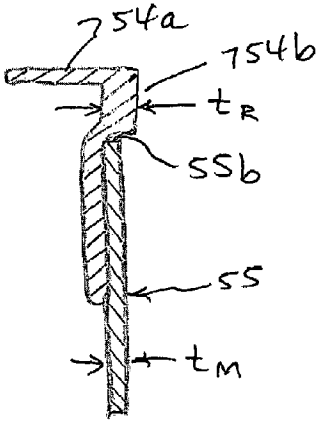
FIG. 31 is a partial, elevational view of the upper rail joined to the mesh piece of FIG. 30.
Figure 30:
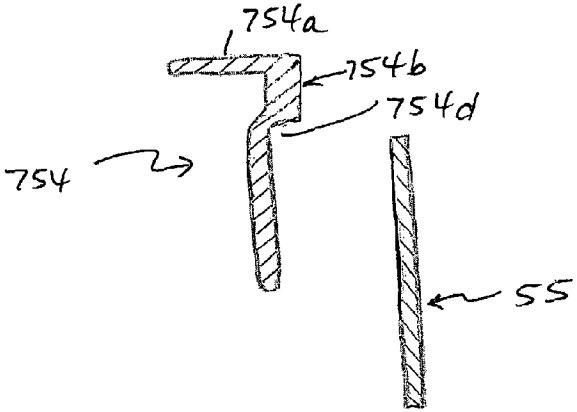
FIG. 30 is a partial, elevational view of a seventh example of an upper rail separated from a mesh piece.

FIGS. 28-29 illustrate an alternative sixth example of upper rail 654 for use with basket portion 55 (shown in FIGS. 3 and 28). Upper rail 654 is similar to upper rail 454 except as noted below. Rail 654 includes first portion 654*a* angularly offset from second portion 654*b* which is offset from third portion 654*c* to form recess 654*d* between second and third portions 654*b*, 654*c*. In the present example (as shown in FIG. 29), rail thickness $t_R$ of second portion 654*b* is less than mesh thickness $t_M$ of basket portion 55 so that upper edge 55*b* of basket portion 55 is not fully received within recess 654*b* and must therefore be ground to ensure edge 55*b* is smooth. Alternatively, the offset between second and third portions 654*b*, 654*c* can be increased so that edge 55*b* is fully received within recess 654*d*. In yet another alternative, rail 754 (see FIGS. 30-31) can be configured similar to rail 654, except rail thickness $t_R$ of second portion 754*b* is greater than mesh thickness $t_M$ of basket portion 55 so that upper edge 55*b* of basket portion 55 is fully received within recess 754*b* and thus does not require grinding.

Rails 654, 754 are joined to basket portions 55 as previously discussed with respect to rail 454. Rail portions 654*a*, 754*a* are operatively associated with runners 26*a-g* of frame 12 (see FIG. 1) during use.

Figure 33:
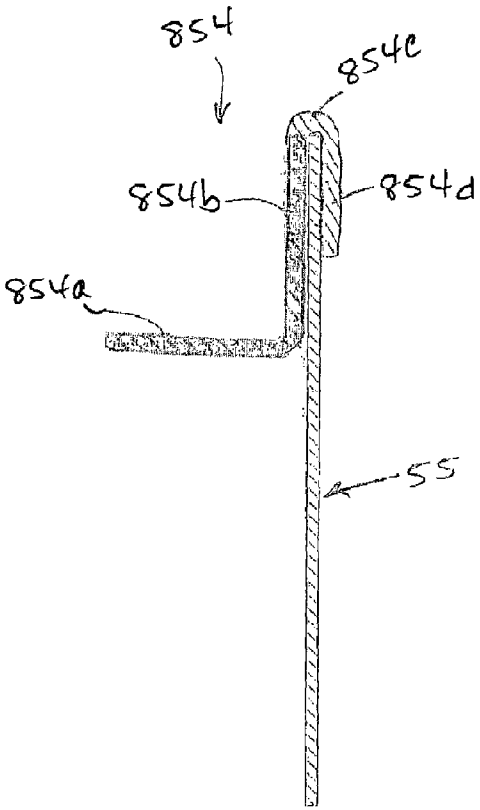
FIG. 33 is a partial, elevational view of the upper rail joined to the mesh piece of FIG. 32.
Figure 32:
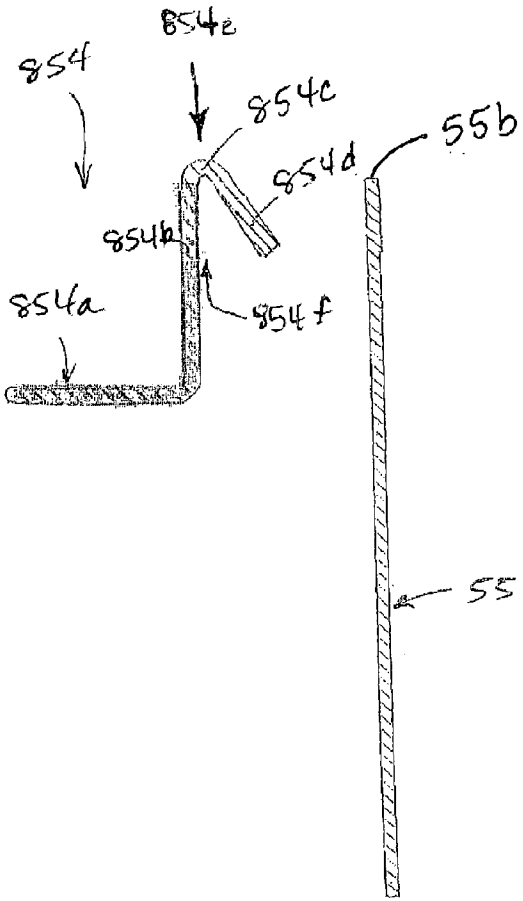
FIG. 32 is a partial, elevational view of an eighth example of an upper rail separated from a mesh piece.
Figure 35:
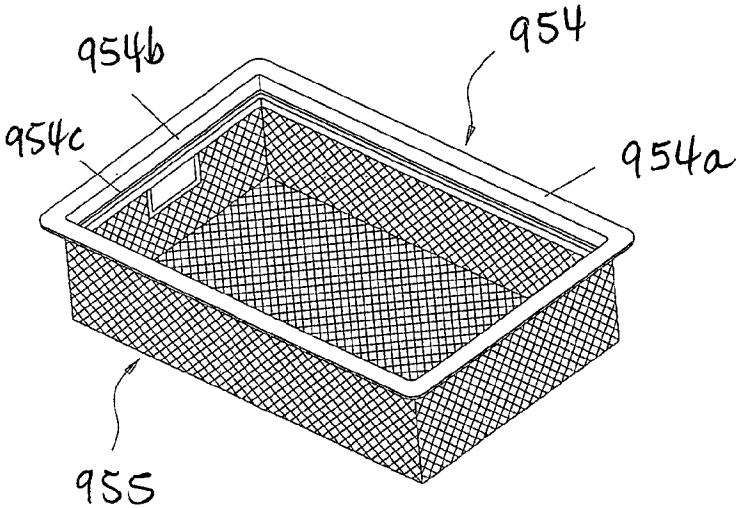
FIG. 35 is a perspective view of the drawer and rail of FIG. 34, wherein the rail is coupled to the drawer.
Figure 34:
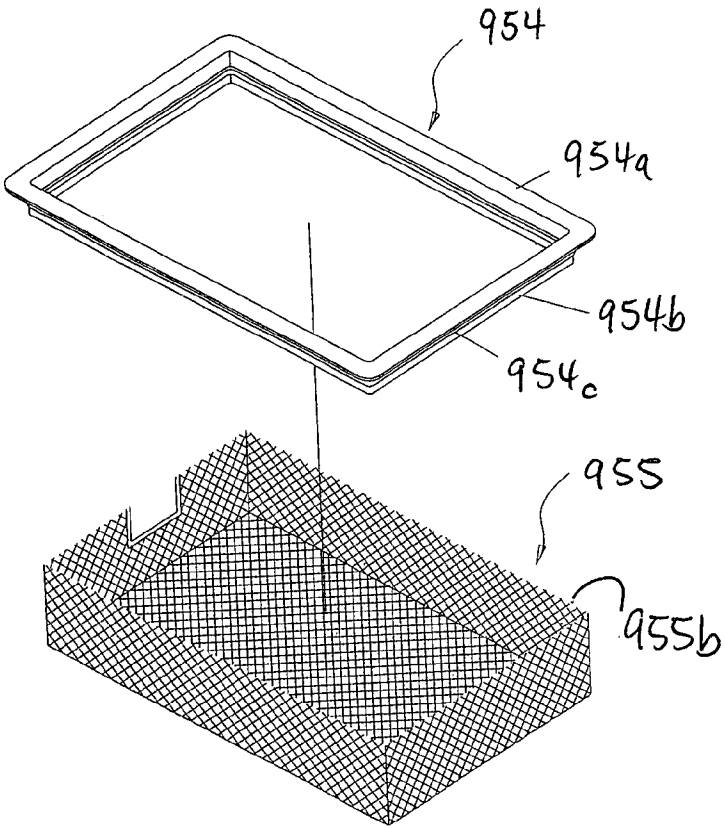
FIG. 34 is an exploded, perspective view of a drawer with a ninth example of an upper rail.

FIGS. 32-33 illustrate an alternative eighth example of upper rail 854 for use with basket portion 55 (shown also in FIG. 3). Rail 854 is similar to rail 454 shown in FIG. 24, except second portion 854*b* of rail 854 is connected to curved section 854*c*, which is connected to extension 854*d*. Curved portion 854*e* of rail 854 is formed by second portion 854*b*, curved section 854*c* and extension 854*d* and also defines opening 854*f*. Rail 854 is bent so that curved portion 854*e* has a generally open V-shape (as shown in FIG. 32).

Upper edge 55*b* of basket portion 55 is inserted into opening 854*f* so that when rail 854 is compressed by a conventional press machine, as shown in FIG. 33, second portion 854*b* and extension 854*e* are adjacent to outer and inner surfaces, respectively, of basket portion 55. Compression also minimizes opening 854*f* (as shown in FIG. 33) and causes curved section 854*c* to tightly engage basket portion 55. Additionally, after compression extension 854*d* is generally vertically-extending and second portion 854*b* and extension 854*d* are welded to the outer and inner surfaces, respectively, of basket portion 55 using a spot-welding machine and fixture similar to the method used for rail 54 (shown in FIGS. 8 and 9).

Once upper rail 854 is joined to basket portion 55 in this manner, it provides additional structural rigidity to the basket portion 55. Using rail 854 eliminates the need to cut upper section 55*a* of basket portion 55 as when using rail 54, as shown in FIGS. 8 and 9. Consequently, rail 854 eliminates the need to deburr basket portion 55.

Figure 36:
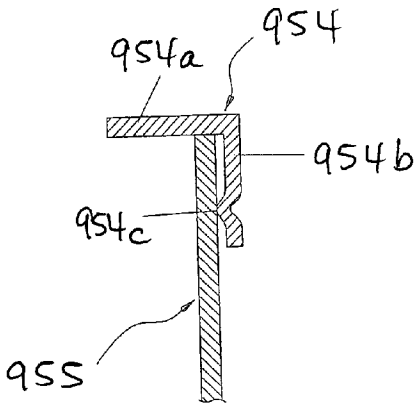
FIG. 36 is a partial, elevational view of the upper rail of FIG. 34 supported by a mesh piece, wherein welding has not occurred.
Figure 37:
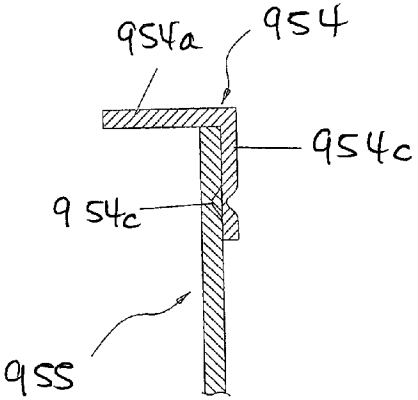
FIG. 37 is a partial, elevational view of the upper rail joined to the mesh piece of FIG. 36, wherein welding has occurred.

FIGS. 34-37 illustrate an alternative ninth example of upper rail 954 for use with basket portion 955. Upper rail 954 is similar to upper rail 454 (shown in FIGS. 26-27), except vertical second portion 954*b* of rail 954 includes an outwardly extending or projecting connection portion or rib 954*c*. The location of rib 954*c* along vertical portion 954*b* can be varied. As shown in FIG. 37, when rail 954 is joined to basket portion 955, horizontal first portion 954*a* covers upper edge 955*b* (shown in FIG. 34) and second portion 954*b* and rib 954*c* contact basket portion 955. After joining rail 954 to basket portion 955, the use of electric welding could allow rib 954*c* and basket portion 955 contacting rib 954*c* to be fused into an integral structure (as shown in FIG. 37). This is due to the heat collection and pressure of resistors used during welding.

Rail 954 adds structural rigidity to basket portion 955 and eliminates the need to cut and deburr basket portion 955. Rail portion 954*a* is operatively associated with runners 26*a-g* of frame 12 (see FIG. 1) during use.

Figure 38:
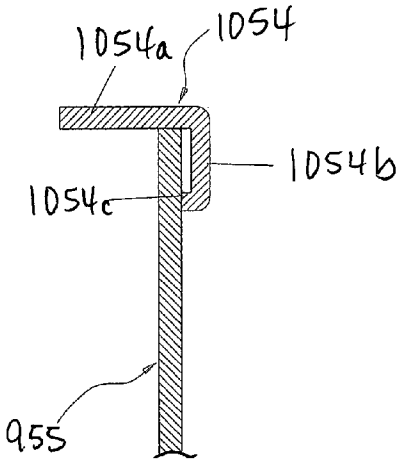
FIG. 38 is a partial, elevational view of a tenth example of an upper rail supported by a mesh piece, wherein welding has not occurred.
Figure 39:
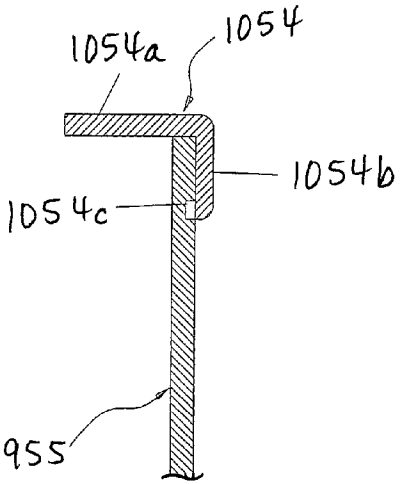
FIG. 39 is a partial, elevational view of the upper rail joined to the mesh piece of FIG. 38, wherein welding has occurred.
Figure 41:
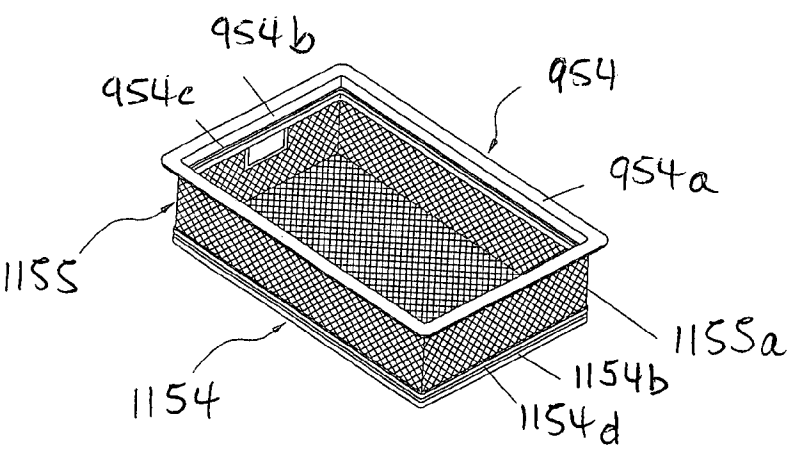
FIG. 41 is a perspective view of the drawer and rails of FIG. 40, wherein the rails are coupled to the basket portion.
Figure 40:
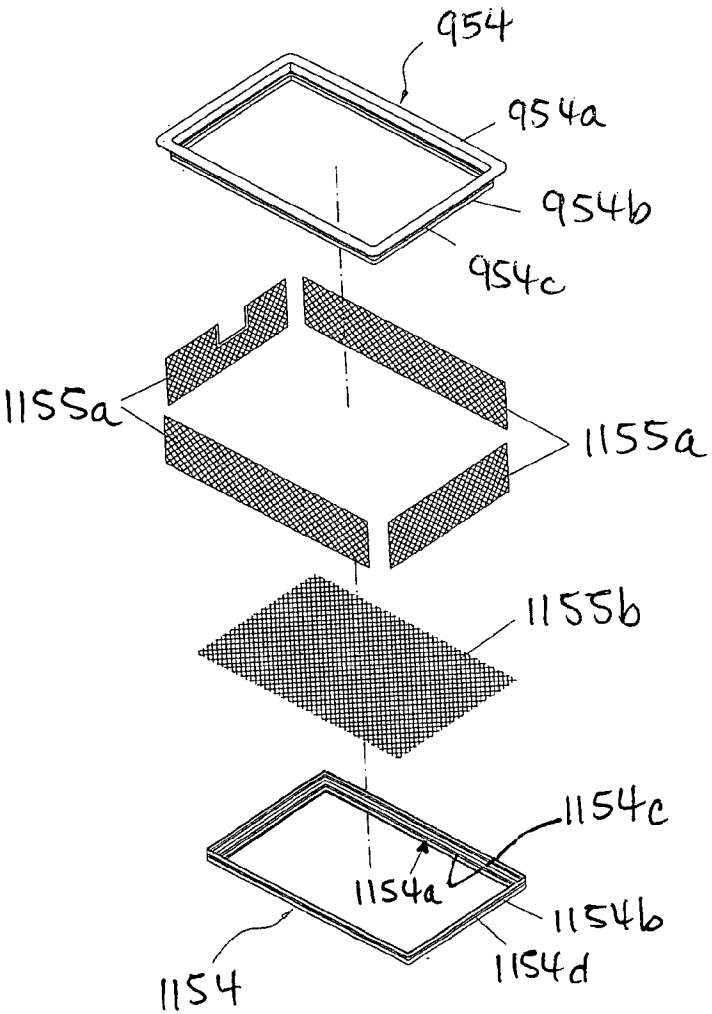
FIG. 40 is an exploded, perspective view of an alternative drawer example with an upper rail of FIG. 36 and a first example of a lower rail.

FIGS. 38-39 illustrate an alternative tenth example of upper rail 1054 for use with basket portion 955. Upper rail 1054 is similar to upper rail 954 (shown in FIGS. 36-37), except rib 954*c* has been replaced with outwardly extending or projecting connection portion 1054*c* at the free end of vertical second portion 1054*b*. When rail 1054 is joined to basket portion 955, horizontal first portion 1054*a* covers upper edge 955*b* (shown in FIG. 34) and second portion 1054*b* and connection portion 1054*c* contact basket portion 955. After joining rail 1054 to basket portion 955, the use of electric welding could allow connection portion 1054*c* and basket portion 955 contacting connection portion 1054*c* to be fused into an integral structure (as shown in FIG. 39).

FIGS. 40-43 illustrate an alternative example of basket portion 1155 with upper rail 954 and lower rail 1154. Basket portion 1155 is formed by four sidewalls 1155*a* of mesh and one bottom wall 1155*b* of mesh. Sidewalls 1155*a* are preferably joined by conventional methods such as welding. Bottom wall 1155*b* can be joined to sidewalls 1155*a* by welding and/or by rail 1154. Upper rail 955 previously described with reference to FIGS. 36-37 is joined to basket portion 1155 as previously discussed.

Figure 43:
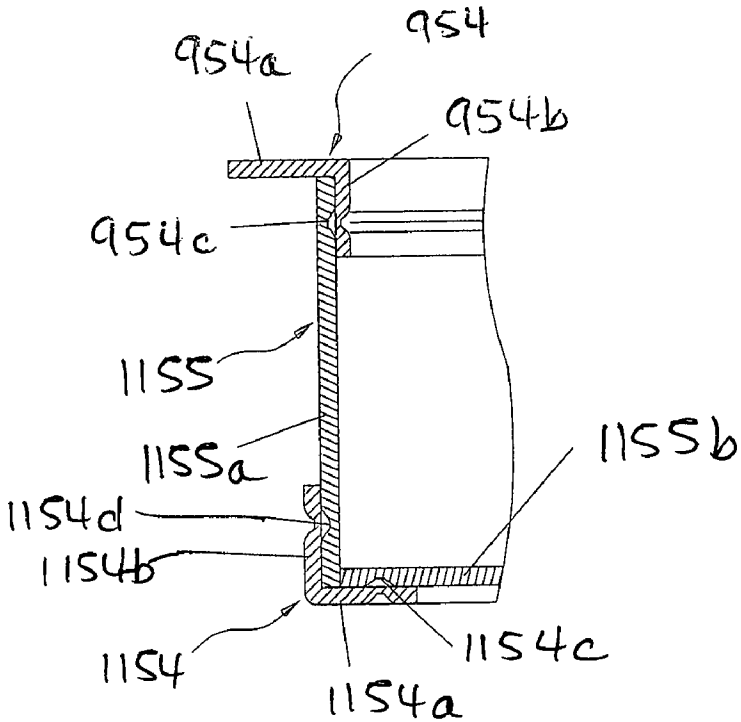
FIG. 43 is a partial, elevational view of the upper and lower rails joined to the mesh piece of FIG. 42, wherein welding has occurred.
Figure 42:
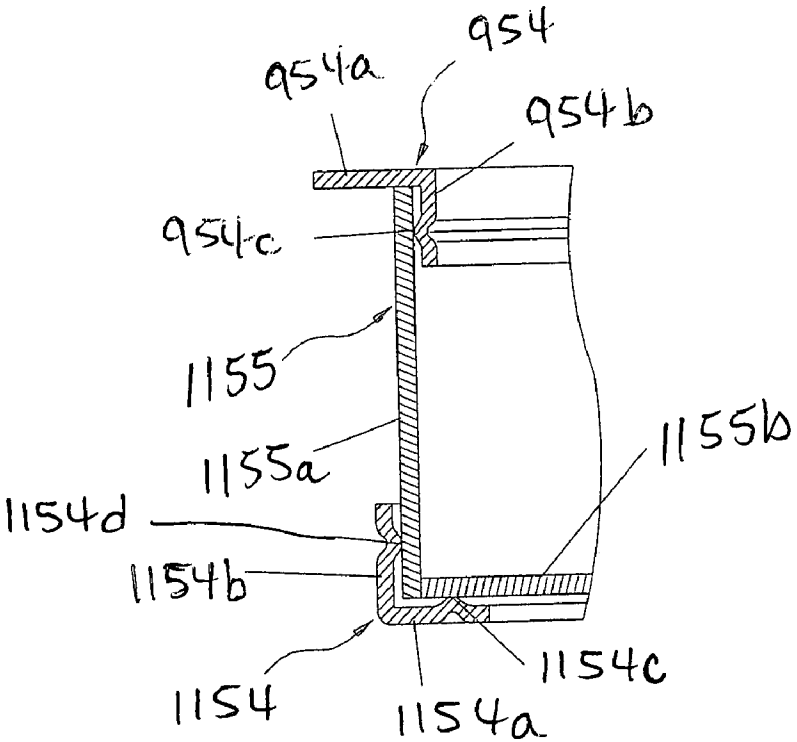
FIG. 42 is a partial, elevational view of the upper and lower rails of FIG. 40 engaged with a mesh piece, wherein welding has not occurred.

Lower rail 1154 includes horizontal first portion 1155*a* and vertical second portion 1155*b*. Horizontal first portion 1155*a* includes inwardly projecting connection portion or rib 1154*c*. Vertical second portion 1155*b* includes inwardly projecting connection portion or rib 1154*d*. When rail 1154 is joined to basket portion 1155, first portion 1154*a* and rib 1155*c* contact bottom wall 1155*b* and second portion 1154*b* and rib 1155*d* contact sidewalls 1155*a*. After joining rail 1154 to basket portion 1155, the use of electric welding (using heat collection and pressure) could allow the ribs 1154*c,d* and basket portion 1155 contacting ribs 1154*c,d* to be fused into an integral structure (as shown in FIG. 43).

Figure 45:
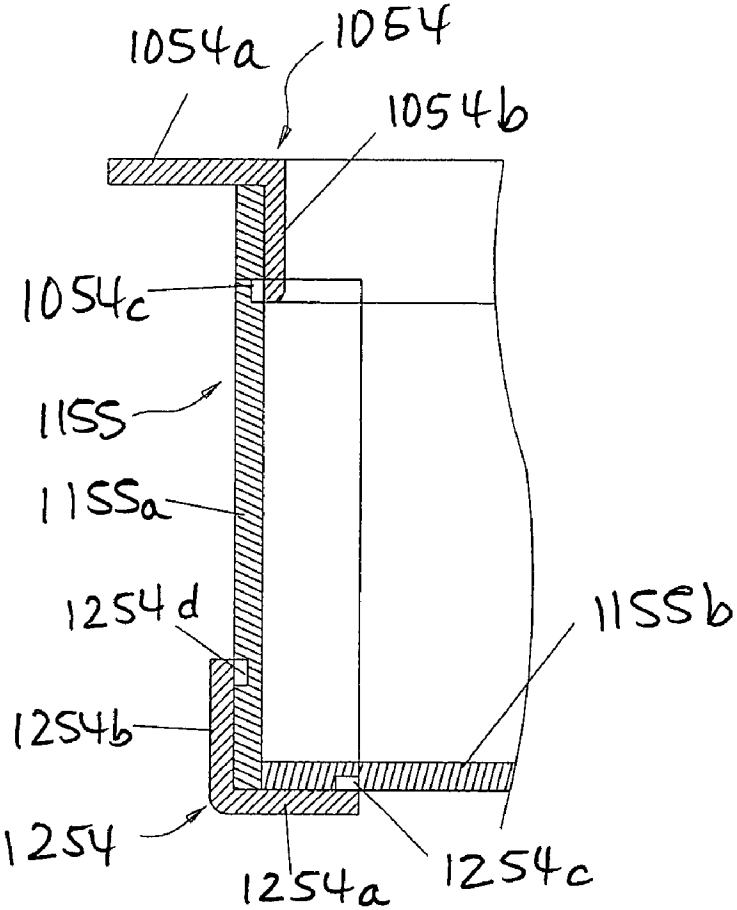
FIG. 45 is a partial, elevational view of the upper and lower rails joined to the mesh pieces of FIG. 44, wherein welding has occurred.
Figure 44:
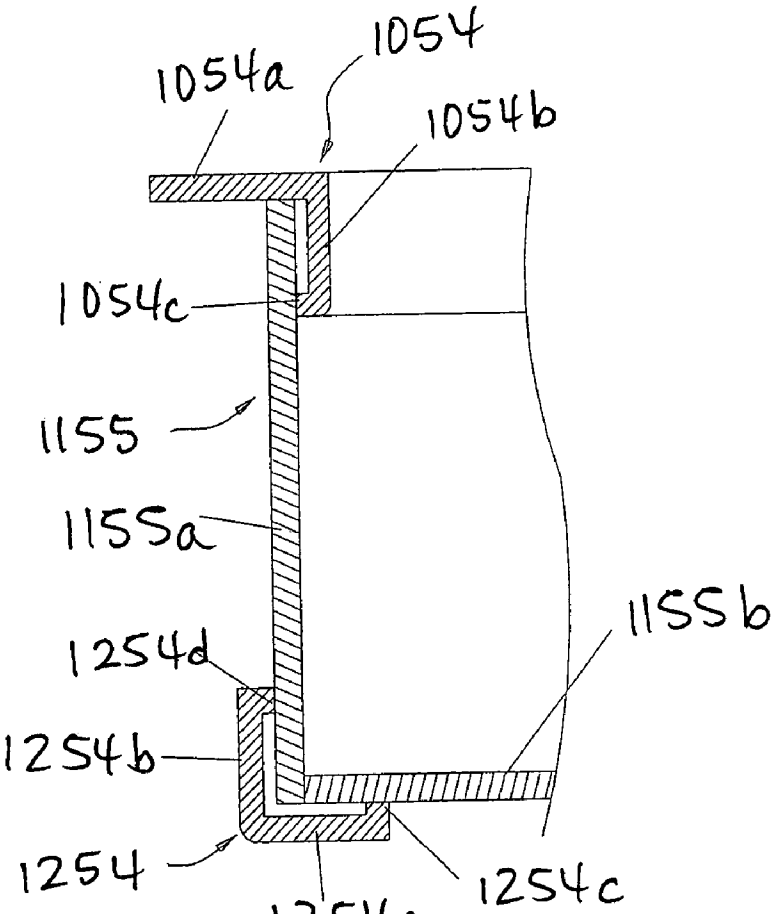
FIG. 44 is a partial, elevational view of the upper rail of FIG. 38 supported by a mesh piece and a second example of a lower rail, wherein welding has not occurred.

FIGS. 44-45 illustrate basket portion 1155 with upper rail 1054 and alternative lower rail 1254. Basket portion 1155 is previously described with reference to FIGS. 40-41. Upper rail 1054 previously described with reference to FIGS. 38-39 is joined to basket portion 1155 as previously discussed.

Lower rail 1254 is similar to lower rail 1154 (shown in FIGS. 42-43), except ribs 1154*c,d* have been replaced with inwardly extending or projecting connection portions 1254*c,d* at the free end of first and second portions 1254*a,b*, respectively. When rail 1254 is joined to basket portion 1155, first portion 1254*a* and rib 1255*c* contact bottom wall 1155*b* and second portion 1254*b* and rib 1255*d* contact sidewalls 1155*a*. After joining rail 1254 to basket portion 1155, the use of electric welding (using heat collection and pressure) could allow connection portions 1254*c,d* and basket portion 1155 contacting the connection portions 1254*c,d* to be fused into an integral structure (as shown in FIG. 43).

Rails 354, 454, 554, 654, 754, 854, 954, 1054, 1154 and 1254 are generally rectangular rings that are continuous about their respective basket portions. These rails are formed of materials similar to those discussed with respect to rails 54 and 54'.

Those skilled in the art will appreciate that the conception, upon which this disclosure is based, may readily be utilized as a basis for designing other products for carrying out the several purposes of the present invention. It is important, therefore, that the claims be regarded as including such equivalent constructions insofar as they do not depart from the spirit and scope of the present invention as defined in the appended claims. Therefore, this invention is not to be limited to the specific examples depicted therein. For example, the features of one example disclosed above can be used with the features of another example. Furthermore, the various rail examples 54, 54', 354, 454, 554, 654, 754, 854, 954, 1054, 1154 and 1254 can be used exclusively in different systems of drawers to provide systems that cost different amounts, e.g., a high-priced system and a lower priced system. Alternatively, one system can have drawers with various types of rails 54, 54', 354, 454, 554, 654, 754, 854, 954, 1054, 1154 and 1254. Additionally, a system can use all closed-corner drawers or combine closed-corner drawers with open-corner drawers in one system. The system may be used with sliding drawers and/or stationary and sliding shelves each supported by a pair of runners. The system frame may also include a section for holding hanging file folders and one or more of the inventive drawers. The drawers of the present invention may be used without a frame. In yet another alternative example, the containers/drawers of the present invention may be retained within a frame formed of wood, plastic, metal, or material with a wood finish, where the frame has components such as runners and rollers thereon. The frame would cooperate with a stationary holder with runners and rollers thereon so that the container does not move with respect to the holder, but when the holder moves between an extended and retracted position by moving with respect to the stationary component, the container likewise moves. In such an example, the runner portion serves to connect the container to the holder without a sliding engagement therebetween. In addition, the container can be formed without upper rail 54 (see FIG. 3) by forming the runner portion in another way, such as by folding the upper edge of the basket portion upon itself to form a sufficiently-rigid integral runner portion. Alternatively, the runner portion need not extend around the entire basket and may extend only on the sides to work with the runners 26*a-g* (see FIG. 1). In such an example, the end walls without the runner portions may have upper edges finished with portions of metal, wood, plastic or some other suitable material. Exemplary rails shown and described above with one basket construction can be used with basket constructions shown in other examples or with conventional basket constructions. For example, the exemplary rails shown and described above can be used with baskets that include sidewalls formed from a single loop of mesh material joined to a separate piece of bottom wall mesh material. Thus, the details of the present invention as set forth in the above-described examples should not limit the scope of the present invention.

Further, the purpose of the Abstract is to enable the U.S. Patent and Trademark Office, and the public generally, and especially the designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

We claim as our invention:

1. A container, comprising:

a basket portion of metal mesh material having a bottom wall, upwardly extending first and second spaced apart sidewalls, upwardly extending third and fourth spaced apart sidewalls, and an upwardly extending opening, said first, second, third and fourth sidewalls including an outer surface;

an upper section of said first, second, third and fourth sidewalls extending generally horizontally outwardly away from said upwardly-extending opening;

a rail including a first section, a second section, and a curved section joining said first and second sections to define an opening therein;

said upper section of said first, second, third and fourth sidewalls positioned in said opening; and said upper sections of said first, second, third and fourth sidewalls being compressed within said opening such that said first and second sections of said rail are generally parallel and horizontally extending outwardly away from said upwardly-extending opening and a substantial portion of said rail extends generally horizontally away from said upwardly-extending opening substantially outwardly from and substantially continuously around said outer surface of said first, second, third and fourth sidewalls of said basket portion.

2. A method of forming a container comprising the following steps:

forming a basket portion of metal mesh material into a bottom wall, upwardly extending first and second spaced apart sidewalls, upwardly extending third and fourth spaced apart sidewalls, and an upwardly extending opening, said first, second, third and fourth sidewalls including an outer surface;

bending an upper section of said first, second, third and fourth sidewalls generally horizontally outwardly away from said upwardly-extending opening;

forming a rail including a first section, a second section, and a curved section joining said first and second sections so that an opening is located therein;

inserting said upper section of said first, second, third and fourth sidewalls into said opening; and joining said rail to said first, second, third and fourth sidewalls by compressing said rail to engage said upper section of said first, second, third and fourth sidewalls such that said first and second sections of said rail are generally parallel and horizontally extending outwardly away from said upwardly-extending opening, such that a substantial portion of said rail extends generally horizontally away from said upwardly-extending opening substantially outwardly from and substantially continuously around said outer surface of said first, second, third and fourth sidewalls of said basket portion.

3. A method of forming a container comprising the following steps:

forming a basket portion of metal mesh material into a bottom wall and upwardly extending first and second spaced apart sidewalls and upwardly extending third and fourth spaced apart sidewalls, said first, second, third and fourth sidewalls including an outer surface;

forming a rail;

joining said rail to said first, second, third and fourth sidewalls such that a substantial portion of said rail extends substantially outwardly from said outer surface of said first, second, third and fourth sidewalls, and said rail extends substantially continuously around said outer surface of said basket portion;

forming said basket portion with an upwardly-extending opening, where said step of joining said rail further includes joining said rail to said first, second, third and fourth sidewalls such that said substantial portion of said rail extends substantially outwardly from said outer surface of said first, second third and fourth sidewalls away from said upwardly-extending opening and generally horizontally; and bending an upper section of said first, second, third and fourth sidewalls generally horizontally outwardly away from said upwardly-extending opening;

said rail including a first section, a second section, and a curved section joining said first and second sections so that an opening is located therein;

inserting said upper section of said first, second, third and fourth sidewalls into said opening; and compressing said rail to engage said upper section of said first, second, third and fourth sidewalls such that said first and second sections of said rail are generally parallel and horizontally extending outwardly away from said upwardly-extending opening.

* * * * *